US006540701B1

(12) United States Patent
Inada

(10) Patent No.: US 6,540,701 B1
(45) Date of Patent: Apr. 1, 2003

(54) MASSAGING MACHINE

(75) Inventor: Nichimu Inada, Osaka (JP)

(73) Assignee: Family Kabushiki Kaisha, Osaka (JP)

( * ) Notice: Subject to any disclaimer, the term of this patent is extended or adjusted under 35 U.S.C. 154(b) by 0 days.

(21) Appl. No.: 09/622,918

(22) PCT Filed: Jan. 11, 1999

(86) PCT No.: PCT/JP99/00063

§ 371 (c)(1),
(2), (4) Date: Sep. 7, 2000

(87) PCT Pub. No.: WO00/41667

PCT Pub. Date: Jul. 20, 2000

(51) Int. Cl.[7] ..... A61H 15/00

(52) U.S. Cl. ..... 601/99; 601/100; 601/101; 601/102; 601/103; 601/111; 601/116

(58) Field of Search ..... 601/97, 90, 98–100, 601/101–103, 114–118, 46, 49–56, 63, 86, 87, 92–95, 126

(56) References Cited

U.S. PATENT DOCUMENTS

| | | | | | |
|---|---|---|---|---|---|
| 4,422,449 | A | * | 12/1983 | Hamabe | 601/99 |
| 4,576,149 | A | * | 3/1986 | Otuka et al. | 601/99 |
| 5,233,973 | A | * | 8/1993 | Gill et al. | 601/103 |
| 5,792,080 | A | * | 8/1998 | Ookawa et al. | 601/115 |
| 6,056,707 | A | * | 5/2000 | Hayashi | 601/99 |
| 6,117,094 | A | * | 9/2000 | Fujii | 601/99 |
| 6,171,266 | B1 | * | 1/2001 | Inada et al. | 601/99 |
| 6,200,282 | B1 | * | 3/2001 | Furuie et al. | 601/98 |

FOREIGN PATENT DOCUMENTS

| | | |
|---|---|---|
| JP | 59-200648 | 11/1984 |
| JP | 1-83262 | 3/1989 |
| JP | 7-148217 | 6/1995 |
| JP | 9-122193 | 5/1997 |
| JP | 9-299432 | 11/1997 |
| JP | 10-243982 | 9/1998 |
| JP | 11-123221 | 5/1999 |
| JP | 2000-60912 | 2/2000 |

* cited by examiner

*Primary Examiner*—Nicholas D. Lucchesi
*Assistant Examiner*—Quang D. Thanh
(74) *Attorney, Agent, or Firm*—Oblon, Spivak, McClelland, Maier & Neustadt, P.C.

(57) ABSTRACT

A massaging apparatus enabled to provide sufficient treatment effects by stimulating the Keiketsu (or the effective spots) in the Eastern Medical Science effectively. The massaging apparatus comprises: memory devices recorded with treatment contents indicating effective point positions to be massaged according to a treatment course and massage actions to be applied to the effective spot positions; and control devices for causing the massage member to massage the effective spot positions of the body of the using person in accordance with the treatment contents recorded in the memory devices. The massaging apparatus further comprises: treatment course select devices for selecting the treatment course. The treatment contents corresponding to the treatment course selected by the treatment course select devices are read out from the memory devices so that the effective spot positions of the body of the using person may be massaged with the massage member by the control devices in accordance with the read treatment contents.

12 Claims, 33 Drawing Sheets

POSTERIOR ASPECT OF TRUNK

LATERAL ASPECT OF
RT. LOWER LEG

MEDIAL ASPECT OF
RT. LOWER LEG

ANTERIOR ASPECT OF
RT. UPPER LEG

POSTERIOR ASPECT OF
RT. UPPER LEG

FIG. 22 (a)

DIAGNOSTIC INQUIRY COURSE

CHOOSE YES OR NO.

DO YOU FEEL STIFF IN THE SHOULDERS MORE FREQUENTLY THAN BEFORE ?

YES NO

151

FIG. 22 (b)

DIAGNOSTIC INQUIRY COURSE

CHOOSE YES OR NO.

ARE YOU IN ANY ONE OF THE FOLLOWING CONDITIONS ?

* UNDER MEDICAL TREATMENT DIRECTED BY A DOCTOR
* HAVING A HEART TROUBLE
* HAVING FEVER
* BEING PREGNANT
* HAVING SOMETHING WRONG IN THE BACKBONE

YES NO

152

FIG. 22 (c)

DIAGNOSTIC INQUIRY COURSE

YOUR CURRENT PHYSICAL CONDITION IS JUDGED TO BE **********.

A MASSAGING COURSE BEST-SUITED TO YOU NOW HAS BEEN SET.

DO YOU WISH TO EXECUTE IT ?

YES NO

153

DIAGNOSTIC INQUIRY COURSE

STOP USE OF THIS MACHINE.

* IF YOU WISH TO USE, YOU MUST CONSULT A DOCTOR AND THEN SELECT A DESIRED COURSE.

154

DIAGNOSTIC INQUIRY COURSE

DIAGNOSTIC INQUIRY COURSE ENDS.

WAIT A MOMENT.

155

RECLINING

MASSAGING OPERATION IS SUSPENDED DURING RECLINING OPERATION.

156

BASIC CONTROLS

DISCRIMINATION OF SHOULDER/WAIST POSITIONS (UPWARD)

MASSAGE OF KENCHU-YU/HAI-YU

MASSAGE OF SHIN-YU/KETSUIN-YU

ADVANCE TO MASSAGE OF KAKU-YU/ KAN-YU OF STEP 54

MASSAGE OF KAKU-YU/KAN-YU

ADVANCE TO MASSAGE OF HI-YU/ SANSHO-YU OF STEP 55

MASSAGE OF HI-YU/SANSHO-YU

MASSAGE OF JIN-YU/DAICHO-YU

ADVANCE TO MASSAGE OF SHOCHO-YU/ JIRYO OF STEP 57

MASSAGE OF SHOCHO-YU/JIRYO

MASSAGING MACHINE

TECHNICAL FIELD

The present invention relates to massaging apparatus.

BACKGROUND ART

In a massaging apparatus of the prior art (as disclosed in Unexamined Japanese Patent Publication No. 9-122193 or 1-83262), the portions to be frequently used by the user are repeatedly massaged and patted in an automatic course within a preset time period. This is thought to have a main purpose to use the massaging apparatus conveniently.

Most of the automatic courses have specific contents composed of three kinds for the upper body, the lower body and the whole body. If the upper body course is selected, for example, the massage mechanism ascends/descends at first to massage/pat mainly the neck and shoulder positions and the back, and these actions are made within a preset time period (usually within 15 minutes). If the lower body course is selected, on the other hand, the massage mechanism massages/pats mainly the waist and the back, and these actions are ended within the preset time period.

The whole body course is a combination of the upper body course and the lower body course so that the massaging/patting actions are made from the neck/shoulder to the waist within the preset time period.

In short, the massage mechanism seems to provide a convenient course of the massaging apparatus simplifying the complicated operations of the using person.

By the healthy boom of recent years, there have been reconsidered the chiropractic, osteopathy and acupuncture of the Eastern Medical Science, and this reconsideration is also made in Western Countries for investigating their effects. This is not only because of the repeated inspections and the short communications with doctors in the Western Medical Science but also because of the problems of damages from or adverse reactions of excessive medicines.

However, the patients willing to go the clinics for the acupuncture/chiropractic are still few because of the costs in the absence of the Health Insurance and because of the dark images.

Especially in the recent years, the effects of the Eastern Medical Science have been introduced by the mass communications so that the home massaging apparatus have been more spreading in the ordinary families than before.

However, few patients understand that massaging apparatus provides effects such as fatigue recovery, improvement in blood circulation, refreshment of muscles, relief of muscular stiffness, remissions of neuralgia/myalgia (in No. 27 of Yakkan, dated on Feb. 2, 1972), and the massaging apparatus has an image as high as a "Kneading Machine".

This is because the concept of the prior art for manufacturing the massaging apparatus is based exclusively on the function to massage/pat the shoulder/waist easily. Therefore, the massaging apparatus of the prior art is not directed to the massage actions aiming at treatments for the mental refreshment or the physical refreshment and, hence, cannot provide the treatment effects according to the treatment purpose.

In view of the problems thus far described, the invention has an object to provide a massaging apparatus enabled to provide sufficient treatment effects by stimulating the Keiketsu (or the effective spots) in the Eastern Medical Science effectively.

DISCLOSURE OF THE INVENTION

The present invention provides the following technical means to attain the above object.

According to the invention, specifically, there is provided a massaging apparatus for massaging the body of a using person with a massage member, comprising: memory means recorded with treatment contents indicating effective point positions to be massaged according to a treatment course and massage actions to be applied to said effective spot positions; and control means for causing the massage member to massage the effective spot positions of the body of the using person in accordance with the treatment contents recorded in said memory means.

In accordance with the desired treatment course, therefore, the Keiketsu (or the effective spots) in the Eastern Medical Science can be so effectively stimulated for the sufficient treatment effects so that the massage aiming at the treatment can be automatically performed.

In the invention, the massaging apparatus further comprises: treatment course select means for selecting the treatment course, whereby the treatment contents corresponding to the treatment course selected by said treatment course select means are read out from said memory means so that the effective spot positions of the body of the using person may be massaged with the massage member by said control means in accordance with the read treatment contents.

As a result, the using person can select the treatment course desired easily so that the effective spots can be automatically massaged according to the desired treatment course thereby to simplify but ensure the treatment by stimulating the effective spots.

In the invention, the massage member further comprises: position discriminating means for discriminating the position of a specific portion of the body of the using person; and effective spot calculating means for calculating the effective spot position of the using person from the specific portion position, as discriminated by said position discriminating means, of the human body of the using person, whereby said massage member is caused to perform the massage actions by moving the massage member sequentially to a plurality of effective spot positions calculated by said effective spot calculating means.

As a result, the position of the specific portion of the body of the using person can be automatically discriminated to calculate the spot location accurately according to the using person from the discriminated specific portion. The massage member can be accurately moved sequentially to a plurality of spot positions so that these spot positions can be automatically massaged with the massage member. Thus, it is possible to practice the massage which can provide the sufficient treatment effects according to the treatment course.

In the invention, the massaging apparatus further comprises: a massage drive unit including a massage member and an air cell made extensible for protruding the massage member toward the using person and contractible for retracting the massage member from the using person, said massage drive unit being made movable along the body of the using person; and a pressure sensor for detecting the internal pressure of said air cell, whereby said massage member is moved along the body of the using person while being protruded toward the using person by the extension of said air cell, so that the position of the specific portion of the body of the using person with respect to said massaging apparatus may be discriminated from the relations between the moving position of the massage member at that time and the internal pressure of the air cell, as detected by said pressure sensor.

As a result, the air cell for protruding/retracting the massage member as it extracts/contracts has its internal pressure widely fluctuate with the load applied thereto so that the internal pressure of the air cell can be fluctuated even with the fine fluctuations of the load. From the relations between the moving position of the massage drive unit and the internal pressure of the air cell, as detected by the pressure sensor, therefore, the location of the specific portion of the body of the using person with respect to the massaging apparatus can be discriminated automatically and accurately so that the effective spot position can be calculated more accurately and massaged reliably.

In the invention, the moving position of the massage drive unit when the changing rate of the internal pressure of said air cell to the moving distance of said massage drive unit fluctuates is discriminated as the position of the specific portion of the body of the using person with respect to said massaging apparatus.

By detecting the position at which the changing rate of the internal pressure of the air cell to the moving distance of the massage drive unit fluctuates, therefore, the position of the specific portion of the body of the using person can be discriminated simply but reliably. As shown in FIG. 13, for example, the position S, at which the internal pressure of the air cell starts its rise from an initial pressure Po while the massage drive unit is moving downward within a range Ls, provides the position at which the changing rate of the internal pressure of the air cell fluctuates and which corresponds to the shoulder position of the human body. By detecting that position S, therefore, the shoulder position can be discriminated simply but reliably. On the other hand, as shown in FIG. 14, the position S, at which the internal pressure of the air cell returns to the initial value Po after the upward movement of the massage drive unit passed a range Lc, provides the position at which the changing rate of the internal pressure of the air cell fluctuates and which corresponds to the shoulder position of the human body. By detecting that position S, therefore, the shoulder position can be discriminated simply but reliably.

In the invention, the moving position of the massage drive unit when the internal pressure of said air cell starts or ends the fluctuation is discriminated as the position of the specific portion of the body of the using person with respect to said massaging apparatus.

By detecting the moving position of the massage drive unit when the internal pressure of the air cell starts or ends its fluctuation, therefore, the position of the specific portion of the body of the using person can be discriminated simply but reliably. As shown in FIG. 13, for example, the position S, at which the internal pressure of the air cell starts its rise from the initial pressure Po while the massage drive unit is moving downward within the range Ls, provides the position at which the internal pressure of the air cell has started its fluctuation and which corresponds to the shoulder position of the human body. By detecting that position S, therefore, the shoulder position can be discriminated simply and reliably. As shown in FIG. 14, on the other hand, the position S, at which the internal pressure of the air cell returns to the initial value Po after the upward movement of the massage drive unit passed over the range Lc, provides the position, at which the internal pressure of the air cell has ended its fluctuation and which corresponds to the shoulder position of the human body. By detecting that position S, therefore, the shoulder position can be discriminated simply but reliably.

In the invention, said position discriminating means discriminate the shoulder position of the body, and said effective spot calculating means calculates the positions of the individual thoracic vertebrae and the individual lumbar vertebrae from the shoulder position and calculates the effective spots from the calculated positions of the thoracic vertebrae and the lumbar vertebrae.

The individual thoracic vertebrae and the individual lumbar vertebrae of the human body are arranged at a generally equal interval along the backbone of the human body, and their corresponding positions provide the individual effective spots of the backbone of the human body. By utilizing the positions of the thoracic vertebrae and the lumber vertebrae, therefore, the individual effective spots along the backbone of the human body can be calculated simply but accurately.

In the invention, when the effective spots of the body of the using person are to be massaged with said massage member, said massage member is caused to perform a pointing action to repeat the massage actions while moving with a width of several centimeters.

Even with more or less errors in the effective spot positions calculated and in the positions of the massage member having moved to the spot positions, therefore, these errors can be absorbed by the pointing actions of the massage member so that the effective spots positions can be reliably massaged by the massage member.

In the invention, the massaging apparatus further comprises: diagnostic inquiry means for performing a diagnostic inquiry to the using person; input means for inputting the answer of the using person to said diagnostic inquiry means; and treatment course decision means for deciding the treatment course on the basis of said answer.

As a result, the treatment course to be applied to the using person can be decided by the diagnostic inquiry so that the effective spot positions suitable for the using person can be treated simply but reliably by the stimulation.

In the invention, the treatment contents recorded in said memory means are the effective spot positions to be massaged according to the treatment course and the massage actions to be made on the effective spot positions, which are programmed by learning the treatments performed by a chiropractor or a massager.

As a result, the massage actions imitating the treating actions of the chiropractor or the massager as they are can be automatically made to perform the more effective treatments according to the treatment course.

In the invention, the treatment contents recorded in said memory means are the effective spot positions to be massaged according to the treatment course and the massage actions to be made on the effective spot positions, which are programmed by learning the clinical cases by the professors or the like of universities investigating the Eastern Medical Science.

As a result, the massage actions imitating those of the clinical cases by the professors or the like as they are can be automatically made to perform the more effective treatments according to the treatment course.

In the invention, said massage member is made movable along the body of the using person for massaging the effective spots along the backbone of the body of the using person.

By moving the massage member along the body of the using person, therefore, the plurality of effective spot positions along the backbone of the body of the using person can be efficiently massaged with the massage member.

In the invention, said massage member includes an air cell to be caused to extend/contract by feeding/discharging compressed air, for massaging the effective spots on the legs of the body of the using person.

As a result, the effective spot positions on the legs of the human body can be effectively massaged by pushing them softly with the air cell. In this respect, too, it is possible to perform the more effective treatments according to the treatment course.

BRIEF DESCRIPTION OF THE DRAWINGS

FIG. 22 presents screens to be displayed by the display unit and showing one example of the content of a diagnostic inquiry at (a), another example of the content of the diagnostic inquiry (concerning massage inhibiting conditions) at (b) and a screen of the result of the diagnostic inquiry at (c);

BEST MODE FOR CARRYING OUT THE INVENTION

An embodiment of the invention will be described with reference to the accompanying drawings.

Figure 1:
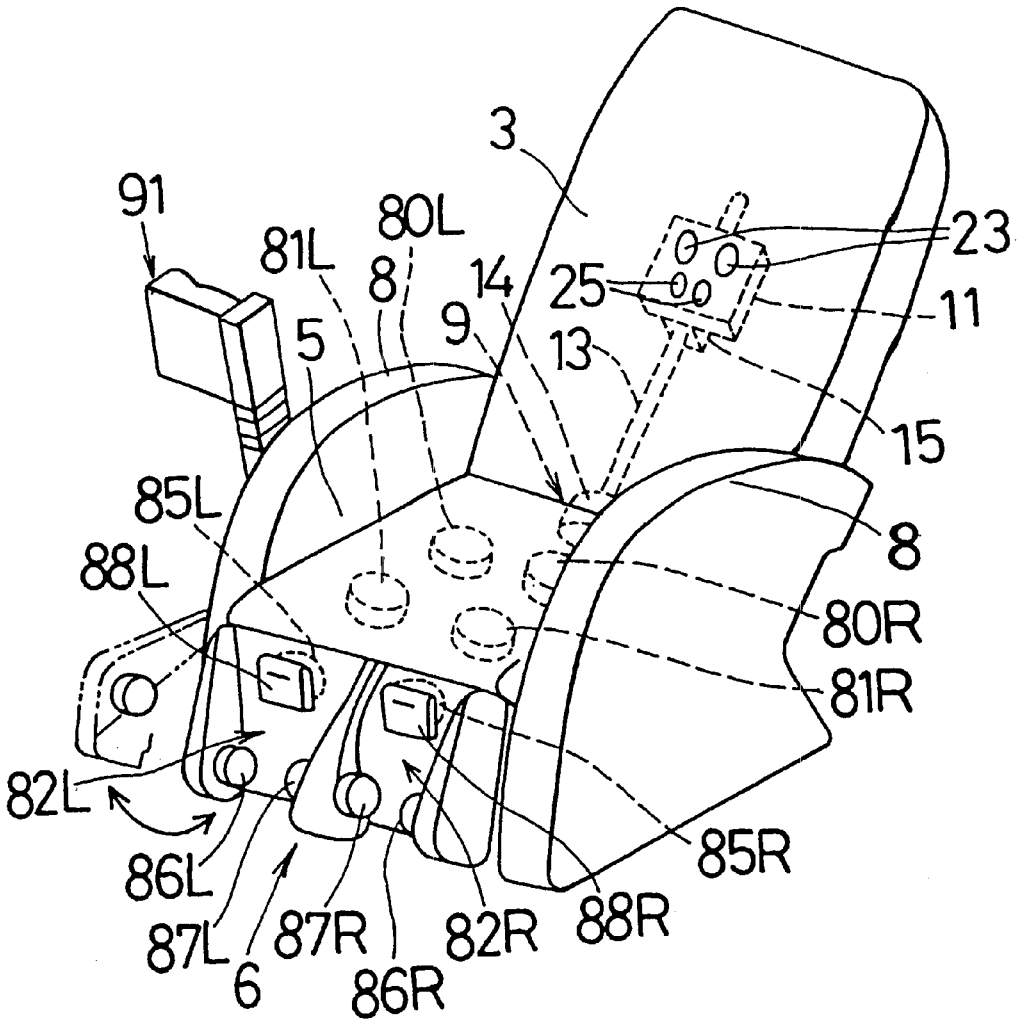
FIG. 1 is a perspective view showing a massaging apparatus of the invention.

FIG. 1 shows a massaging apparatus 1 according to the invention. This massaging apparatus 1 has the body which is constructed to include: a back portion 3; a seat portion 5; a foot rest 6 disposed in front of the seat portion 5; and arm rests 8 disposed at the back and on the left and right sides of the seat portion 5.

As shown in FIGS. 1 to 6, a massage drive unit 11 which can be moved upward and downward by a moving drive unit 9 is provided in the back portion 3.

This moving drive unit 9 is provided with a longitudinally feeding threaded spindle 13 disposed in the height direction of the back portion 3, and a prime mover 14 having an electric motor with a reduction gear for turning the longitudinally feeding threaded spindle 13 forward and backward on its axis. This longitudinally feeding threaded spindle 13 is vertically screwed through a nut portion 15 which is disposed at the back of the massage drive unit 11.

By the moving drive unit 9, the massage drive unit 11 can be (linearly) moved upward/downward in the back portion 3 to the neck side or waist side of a using person and can be stopped at an arbitrary position.

The massage drive unit 11 is provided with an upper drive portion 19 disposed on the upper side of a drive unit base 17, and a lower drive portion 21 disposed on the lower side of the drive unit base 17. The upper drive portion 19 is provided with a massage member 23 (as will be called the "upper massage member") for the massage actions. The lower drive portion 21 is also provided with massage member 25 (as will be called the "lower massage member") for the massage actions.

The massage drive unit 11 is further provided with an upper auxiliary drive portion 27 for moving the upper drive portion 19 itself toward the using person, and a patting drive portion 29 for the patting massage actions of the lower massage member 25.

The drive unit base 17 is constructed of a bottom plate 17*a* and left and right side walls 17*b* erected from the left and right side edges of the bottom plate 17*a*. The aforementioned individual drive portions 19, 21, 27 and 29 are arranged on the drive unit base 17.

The upper drive portion 19 is provided with a pair of left and right air cells 33L and 33R mounted on an upper air cell base 31, and a pair of left and right rocking plates (or rocking members) 35L and 35R which are actuated to rock as the individual air cells 33L and 33R extend/contract.

The upper massage member 23 is composed of a pair of left and right massage heads 23L and 23R (as will be called the "upper left massage head 23L" and the "upper right massage head 23R"), of which the upper left massage head 23L is mounted on the left rocking plate 35L through an arm 36 whereas the upper right massage head 23R is mounted on the right rocking plate 35R through an arm 36.

The air cells 33L and 33R are formed at their side walls into a bellows-shaped cylinder so that they extend toward the using person, when fed with compressed air from the not-shown air supply source, and contract to restore the initial shape when released. By the not-shown change-over valves, air cells can be actuated independently or simultaneously (as in the remaining air cells to be described hereinafter).

The rocking plates 35L and 35R are enabled to rock on left and right rocking pins 37L and 37R, respectively, which are supported at their two longitudinal ends by supporting portions 39 mounted on the upper air cell base 31. On those individual rocking pins 37, on the other hand, there are fitted springs 41 for biasing the rocking plates 35L and 35R toward the upper air cell base 31.

To the back sides of the rocking plates 35L and 35R, there are attached caps 42 for positioning the rocking plates 35L and 35R on the air cells 33L and 33R.

Figure 2:
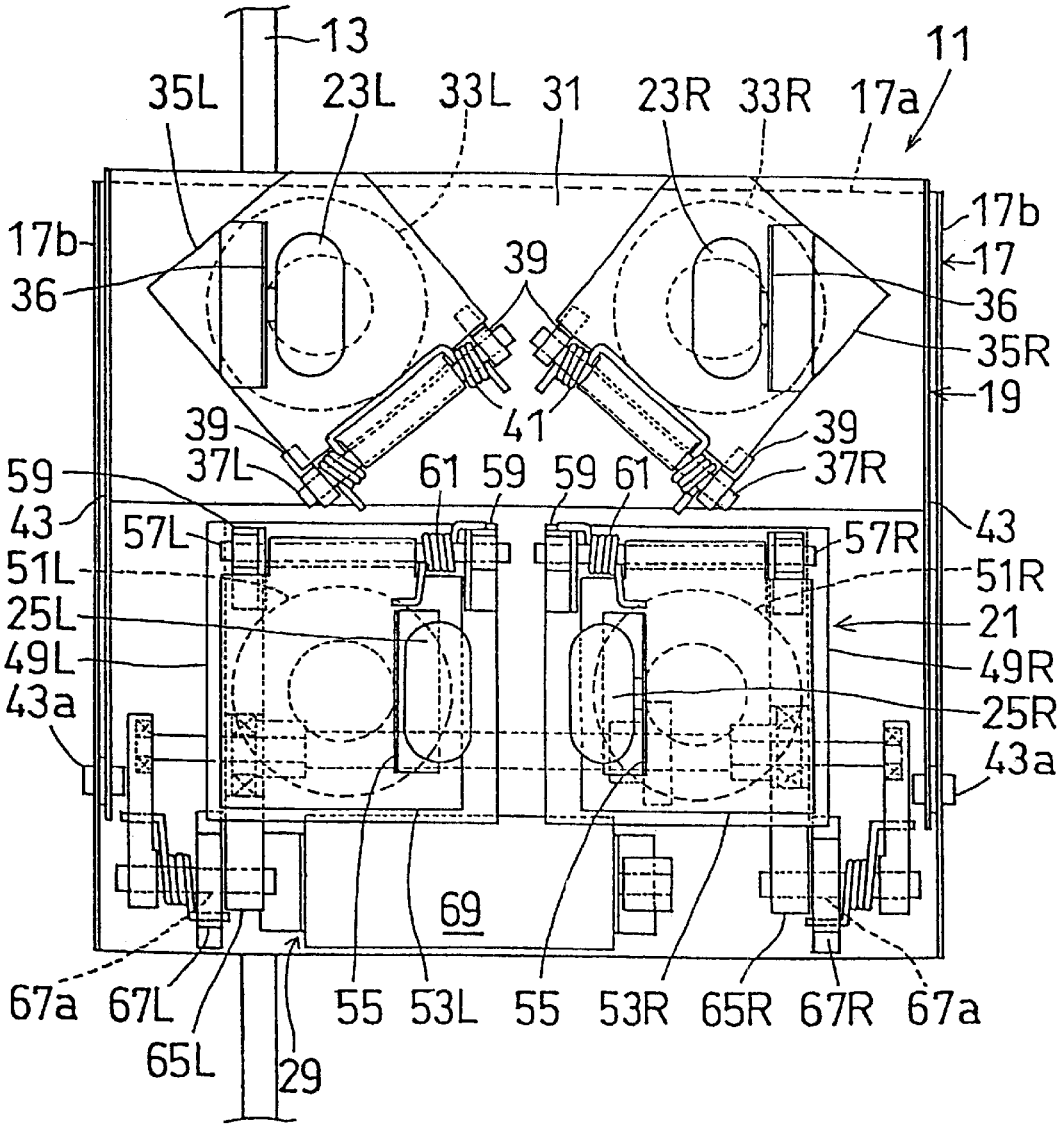
FIG. 2 is a front elevation showing a massage drive unit.

As shown in FIG. 2, the left-hand rocking pin 37L is arranged to have its axis directed upward to the right, and the right-hand rocking pin 37R is arranged to have its axis directed upward to the left. Where the left-hand air cell 33L extends, therefore, the upper left-hand massage head 23L protrudes rightward and downward to the using person. Where the right-hand air cell 33R extends, on the other hand, the upper right-hand massage head 23R protrudes leftward and downward to the using person.

The upper air cell base 31 is attached to the left and right side walls 17*b* of the drive unit base 17 through links 43 disposed on its left and right sides. These links 43 are so attached to the left and right side walls 17*b* as to turn on transverse pins 43*a* so that the upper air cell base 31 can rock toward the using person.

The upper auxiliary drive portion 27 is composed of a pair of left and right bellows-shaped air cells 45L and 45R. These air cells 45L and 45R are arranged between the upper air cell base 31 and the drive unit base 17. On the back side of the upper air cell base 31, there are disposed caps 47 for positioning the air cells 45L and 45R.

Figure 3:
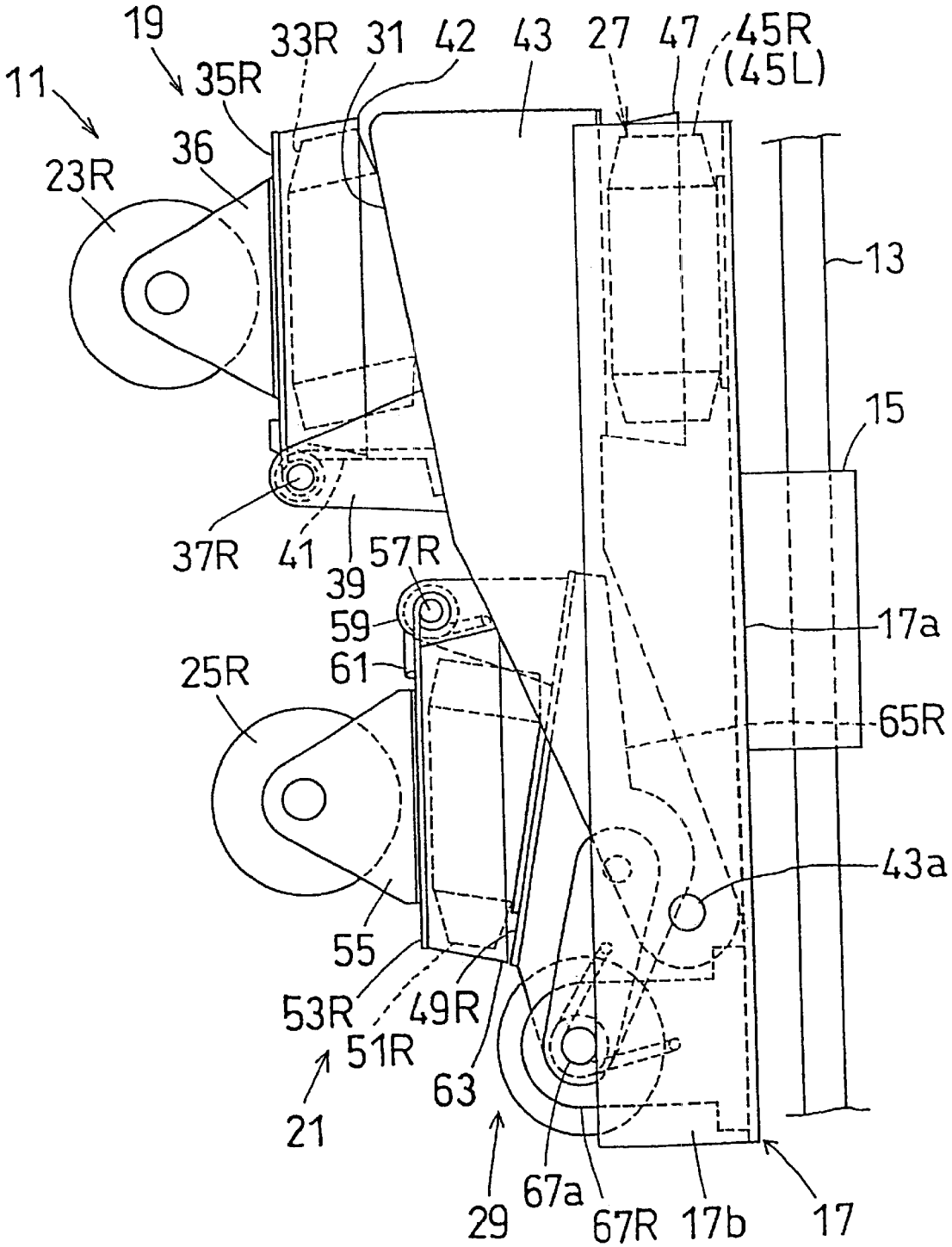
FIG. 3 is a side elevation of the massage drive unit.
Figure 4:
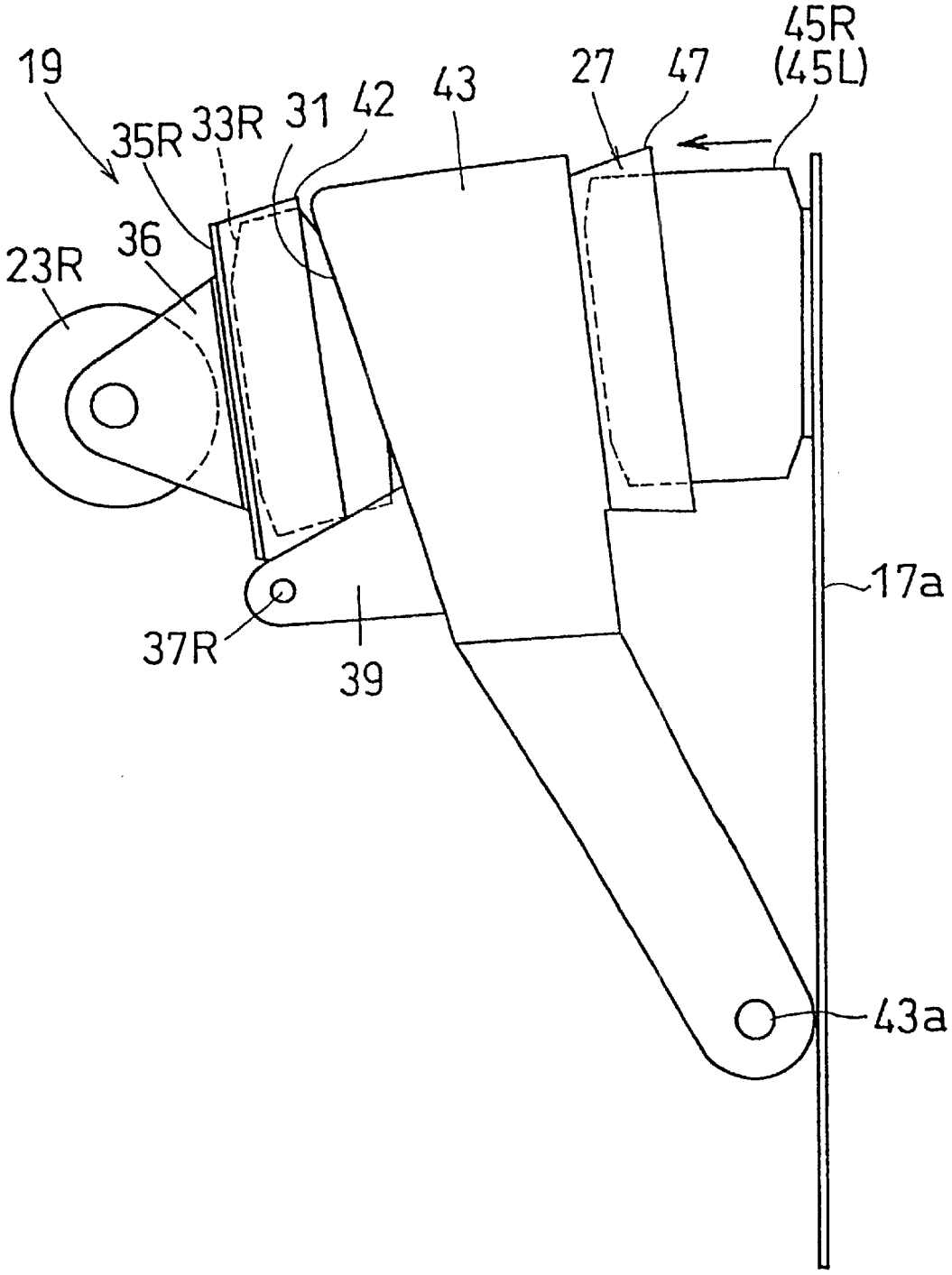
FIG. 4 is a side elevation showing the state in which an upper auxiliary drive unit has acted.

As the air cells 45L and 45R extend, the upper drive portion 19 shifts from the state shown in FIG. 3 to the state shown in FIG. 4. In other words, the upper massage member 23 protrudes rather downward to the using person. When the air cells 45L and 45R contract, on the other hand, the upper massage member 23 retracts to the state of FIG. 3.

The lower drive portion 21 is provided with bellows-shaped air cells 51L and 51R which are mounted on a pair of left and right lower air cell bases 49L and 49R, respectively, and a pair of left and right rocking plates (or rocking members) 53L and 53R which rock as the individual air cells 51L and 51R extend and contract.

The lower massage member 25 is composed of a pair of left and right massage heads 25L and 25R (as will be called the "lower left-hand massage head 25L" and the "lower right-hand massage head 25R", respectively), of which the lower left-hand massage head 25L is mounted on the left-hand rocking plate 53L through an arm 55 whereas the lower right-hand massage head 25R is mounted on the right-hand rocking plate 53R through an arm 55.

These rocking plates 53L and 53R are enabled to rock on left and right rocking pins 57L and 57R, respectively, and these rocking pins 57 are supported at their two longitudinal ends by support portions 59 disposed on a lower air cell base 49. On the rocking pins 57, on the other hand, there are fitted springs 61 for biasing rocking plates 53 toward the lower air cell base 49.

To the back sides of the rocking plates 53L and 53R, there are individually attached caps 63 for positioning the rocking plates 53L and 53R on the air cells 51L and 51R.

The rocking pins 57L and 57R have their axes directed crosswise. As the left-hand air cell 51L extends, therefore, the lower left-hand massage head 25L protrudes upward (or upright) to the using person. As the right-hand air cell 51R extends, on the other hand, the lower right-hand massage head 25R likewise protrudes upward (or upright) to the using person.

The lower air cell bases 49L and 49R are attached to holding portions 67L and 67R on the drive base 17, respectively, through links 65L and 65R disposed on the left and right outer sides thereof. These links 65L and 65R are so held on the holding portions 67L and 67R as to turn on pins 67*a* which are directed crosswise.

The padding drive portion 29 protrudes and retracts those individual links 65L and 65R alternately and quickly to the using person thereby to cause the lower massage member 25 to perform the patting actions.

Figure 5:
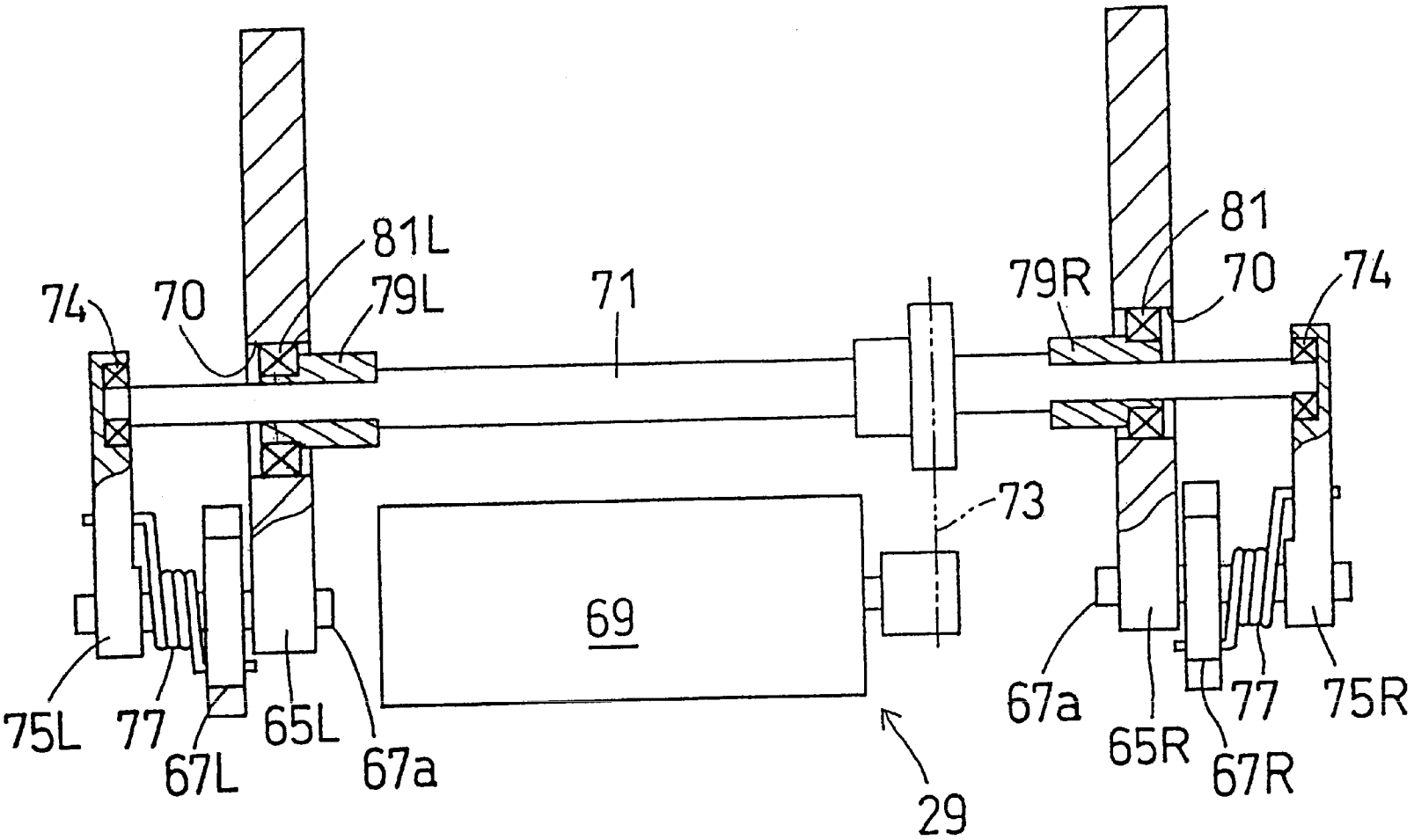
FIG. 5 is a front elevation showing a padding drive unit.
Figure 6:
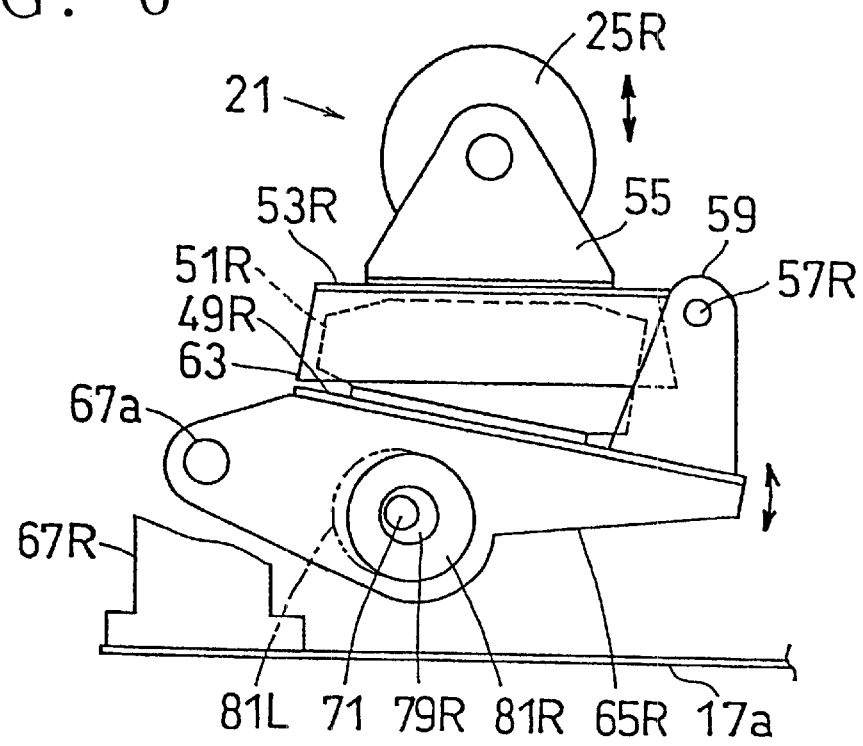
FIG. 6 is a side elevation showing the padding drive unit.

This patting drive portion 29 is provided, as shown in FIG. 5, with a drive motor 69, and a patting shaft 71 which extends through a through hole 70 of each of the links 65L and 65R. The patting shaft 71 is rotationally driven on its transverse axis by the motor 69 through an endless belt 73. Here, the holding portions 67L and 67R are provided with bearings 75L and 75R for holding the two longitudinal ends of the patting shaft 71 through bearings 74. The bearings 75L and 75R are so mounted as to rotate on the pins 67*a* disposed transversely with respect to the holding portions 67L and 67R. Between the holding portions 67L and 67R and the bearings 75L and 75R, there are interposed springs 77 for biasing the bearings 75L and 75R toward the drive base 17 (or away from the using person).

On a portion of the patting shaft 71 passing through the through holes 70, there are fitted and fixed cams 79L and 79R which are eccentric with respect to the axis of the patting shaft 71. These cams 79L and 79R are rotatably held on bearings 81L and 81R which are fitted in the through holes 70. The individual cams 79L and 79R are mounted eccentrically in different directions to each other so that the left and right links 65L and 65R quickly repeat protrusions and retractions alternately toward and away from the using person as the patting shaft 71 rotates. As a result, the lower left-hand massage head 25L and the lower right-hand massage head 25R repeat the protrusions and retractions alternately toward and away from the using person thereby to perform the patting actions.

Thus, the lower massage member 25 can exhibit the pushing actions by the extensions and contractions of the air cells 51L and 51R and the patting actions by the rotations of the patting shaft 71. Where there is a distance between the massage members and the part to be treated (e.g., where the waist is to be massaged), on the other hand, the part to be treated can be effectively patted with the lower massage member 25 in abutment by extending the air cells 51. Moreover, the patting power is transmitted to the lower massage member 25 through the air cells 51L and 51R so that the air cells 51L and 51R can play a role of a cushion to perform soft patting actions.

Figure 7:
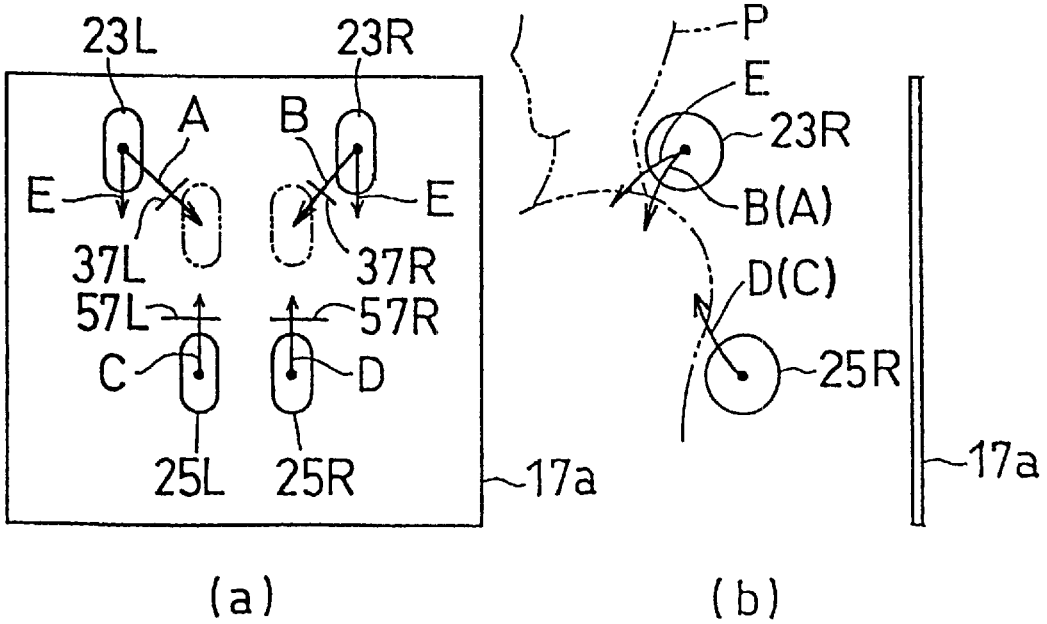
FIG. 7 presents conceptual diagrams showing the acting directions of individual massage heads and a front elevation at (a) and a side elevation (b)

With reference to FIG. 7, here will be described the action patterns (1) to (16) of the upper left-hand massage head 23L, the upper right-hand massage head 23R, the lower left-hand massage head 25L and the lower right-hand massage head 25R.

(1) When the air cell 33L exclusively extends, the upper left-hand massage head 23L pushes in the direction of an arrow A. When the air cell 33L contracts, the upper left-hand massage head 23L returns on the same track but backward of the arrow A.

(2) When the air cell 33R exclusively extends, the upper right-hand massage head 23R pushes in the direction of an arrow B. When the air cell 33R contracts, the upper right-hand massage head 23R returns on the same track but backward of the arrow B.

As shown in FIG. 7(*b*), the tracks, as indicated by the arrows A and B, of the left and right upper massage heads 23L and 23R are directed downward while approaching the using person P so that they are suited for pressing the shoulder downwardly.

(3) When the air cell 51L exclusively extends, the lower left-hand massage head 25L pushes in the direction of arrow C. When the air cell 51L contracts, the lower left-hand massage head 25L returns on the same track but backward of the arrow C.

(4) When the air cell 51R exclusively extends, the lower right-hand massage head 25R pushes in the direction of arrow D. When the air cell 51R contracts, the lower right-hand massage head 25R returns on the same track but backward of the arrow D.

As shown in FIG. 7(*b*), the tracks, as indicated by the arrows C and D, of the left and right lower massage heads 25L and 25R are directed upward while approaching the using person P so that they are suited for pushing up the waist or the like.

(5) When the air cell 33L and the air cell 33R act, the left and right upper massage heads 23L and 23R act to massage in the directions of the arrows A and B. These massages are suitable for the neck and the shoulders because they not only push downward but also massage crosswise. On the other hand, the massage heads 23L and 23R have low pinching forces so that their loads on the using person are light.

(6) When the air cell 51L and the air cell 51R act, the left and right lower massage heads 25L and 25R push up simultaneously.

(7) When the air cell 33L and the air cell 51R act, the upper left-hand massage head 23L and the lower right-hand massage head 25R act in the directions of the arrows A and D to perform the massages to twist the body obliquely (as will be called the "twisting massages").

(8) When the air cell 33R and the air cell 51L act, the upper right-hand massage head 23R and the lower left-hand massage head 25L act in the direction of the arrows B and C to perform the twisting massages in a direction different from that of the action pattern (7).

(9) When the air cell 33L and the air cell 51L act, the upper left-hand massage head 23L and the lower left-hand massage head 25L act in the directions of the arrows A and C to perform massages in the vertical directions (as will be called the "longitudinal massages").

(10) When the air cell 33R and the air cell 51R act, the upper right-hand massage head 23R and the lower right-hand massage head 25R act in the directions of the arrows B and D to perform the longitudinal massages as in the action pattern (9).

(11) When the air cells 33L and 33R and the air cells 51L and 51R act, the vertical massages are performed on the left and right. These vertical massages, when applied to the shoulders, are similar to massage by human hands and hence is effective. Since the upper massage heads 23L and 23R are arranged to protrude closer to the using person P than the lower massage heads 25L and 25R, on the other hand, the upper and lower massage heads can fit the body along the body line near the shoulders, as shown in FIG. 7(*b*).

Since the transverse spacing between the upper left-hand massage head 23L and the upper right-hand massage head 23R is made wider than that between the lower left-hand massage head 25L and the lower right-hand massage head 25R, moreover, the left and right upper massage heads 23L and 23R come closer, as they protrude toward the using person P, to the left and right lower massage heads 25L and 25R thereby to perform actions to grasp the part to be treated.

(12) When the air cells 45L and 45R act, the upper left-hand massage head 23L and the upper right-hand massage head 23R push in the direction of arrow E. These actions have not the transverse component unlike the action patterns (1), (2) and (5) (i.e., the actions of the arrows A and B) but the gentle downward components so that they provide pushing feels different from those of the patterns (1), (2) and (5).

(13) The air cells 45L and 45R are extended to protrude the left and right upper massage heads 23L and 23R to the using person P and are then contracted while causing the air cells 33L and 33R to act. Then, the left and right upper massage heads 23L and 23R perform the so-called "pulling massages" in which they massage the part to be treated, while pulling the part backward. Thus, the upper massage member 23 is caused to move three-dimensionally thereby to provide massage feels like massage by human hands.

(14) A variety of massage actions can be obtained by activating the air cells 45L and 45R and by combining the action patterns (1) to (11).

(15) When the motor 69 is energized, the patting actions are performed by the left and right lower massage heads 25L and 25R.

(16) A variety of massage actions are obtained by energizing the motor 69 and by combining the action patterns (1) to (14).

Figure 17A:
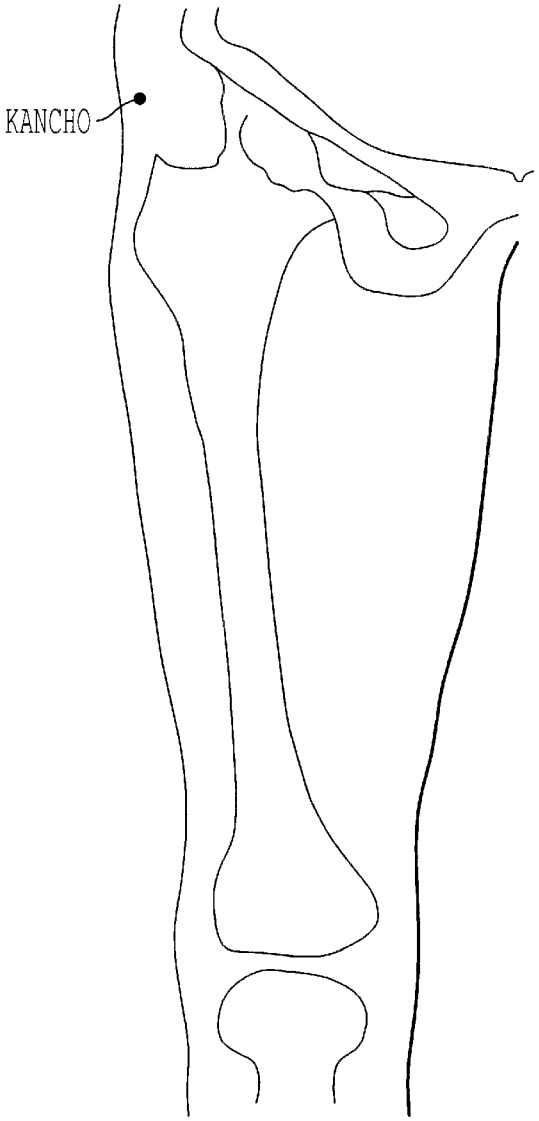
FIG. 17 is a diagram of an anterior aspect and a posterior aspect showing effective spots of an upper leg.
Figure 17B:
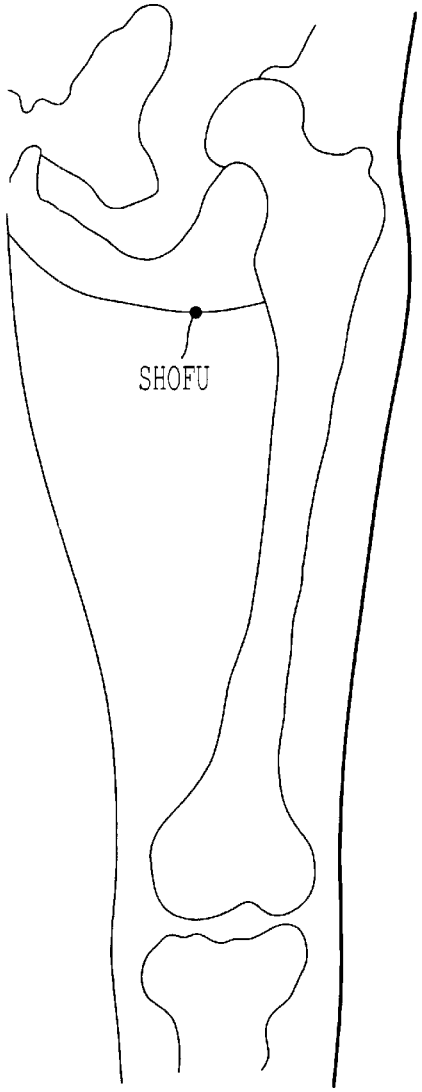

As shown in FIG. 1, the seat portion 5 is provided with a pair of left and right air cells 80L and 80R on the back side and a pair of left and right air cells 81L and 81R on the front side. The paired left and right air cells 80L and 80R on the back side are located to correspond to the effective spot positions of the human body, as called the "Kancho", as shown in FIG. 17. The paired left and right air cells 81L and 81R on the front side are located to correspond to the effective spot positions of the human body, as called the "Shofu", as shown in FIG. 17.

The foot rest 6 is provided with grooved foot resting portions 82L and 82R on which the left and right feet can be placed independently of each other. These foot resting portions 82L and 82R are provided with air cells 85L and 85R on their bottoms close to the seat portion 5 and with individually two or totally four air cells 86L and 86R, and 87L and 87R on the two opposed faces of the foot resting portions 82L and 82R close to their leading ends.

These air cells 85L and 85R, 86L and 86R, and 87L and 87R of the foot rest 6 are provided for pushing the legs as they extend and contract. The air cells 85L and 85R are located to correspond to the effective spot positions of the human body, as called the "Shokin" shown in FIG. 16; the air cells 86L and 86R are located to correspond to the effective spot positions of the human body, as called the "Yoho" shown in FIG. 20; and the air cells 87L and 87R are located to correspond to the effective spot positions of the human body, as called the "Saninko" shown in FIG. 16. Especially, the air cells 85L and 85R close to the seat portion push the backs of the calves through applicators 88L and 88R whereas the air cells 86L and 86R, and the 87L and 87R close to the front push the ankles in a clamping manner.

The air cells 80L and 80R, 81L and 81R, 85L and 85R, 86L and 86R, and 87L and 87R thus far described are made to extend and contract as the compressed air is fed and released by the not-shown air supply source, and these air feed and release are switched by the not-shown change-over valves. By the expansions and contractions of these air cells 80L and 80R, 81L and 81R, 85L and 85R, 86L and 86R, and 87L and 87R, the individual effective spots of the human body, that is, the aforementioned "Kancho", "Shofu", "Shokin" and "Saninko/Yoho" are pushed and massaged.

Here, the back portion 3 can be reclined. This reclining motion is effected by the (not-shown) electric motor.

Figure 8:
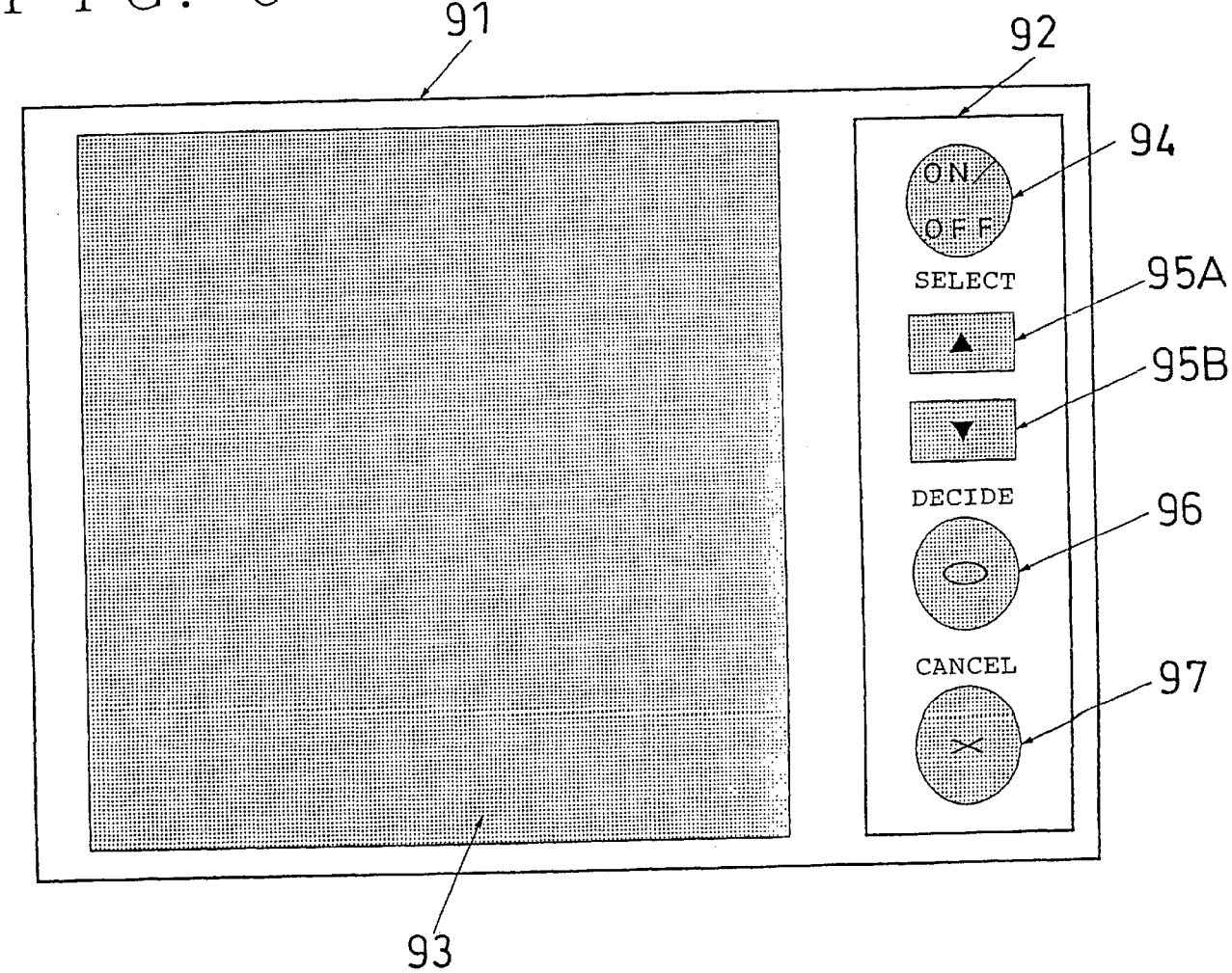
FIG. 8 is a top plan view showing a control panel.

One of the left and right arm rests 8 is provided with a control panel 91. This control panel 91 controls the operations of the massaging apparatus 1 and is constructed to include a control unit 92 having switches and a display unit 93 for making various displays, as shown in FIG. 8.

The operation unit 92 is equipped with a power switch 94, select switches 95A and 95B, a decide switch 96 and a cancel switch 97. The display unit 93 is made of a liquid-crystal display.

Figure 9:
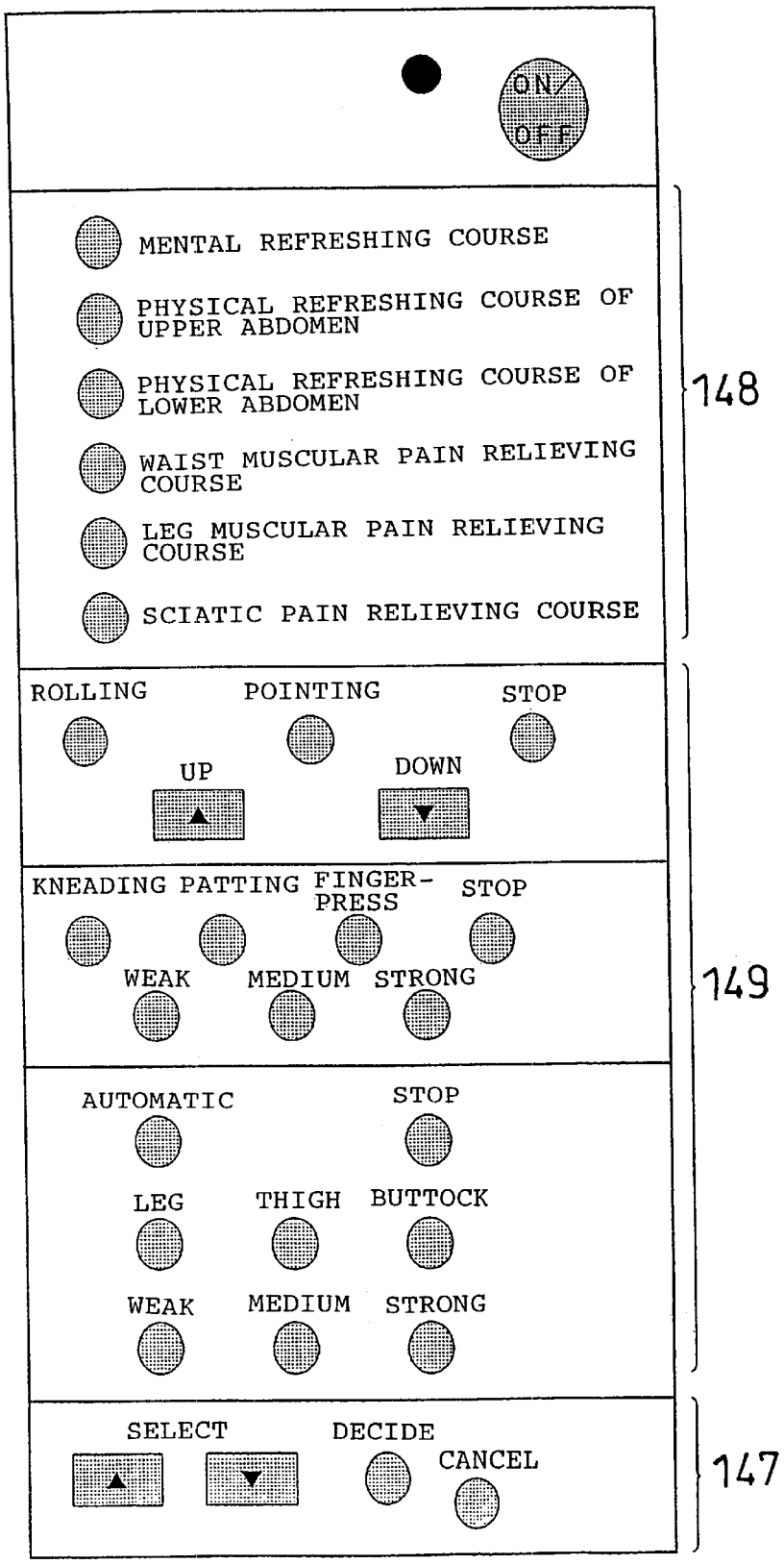
FIG. 9 is a top plan view showing a remote control device.

On the other hand, the controls of the massaging apparatus 1 can also be made by a remote control device 98, as shown in FIG. 9.

Figure 10:
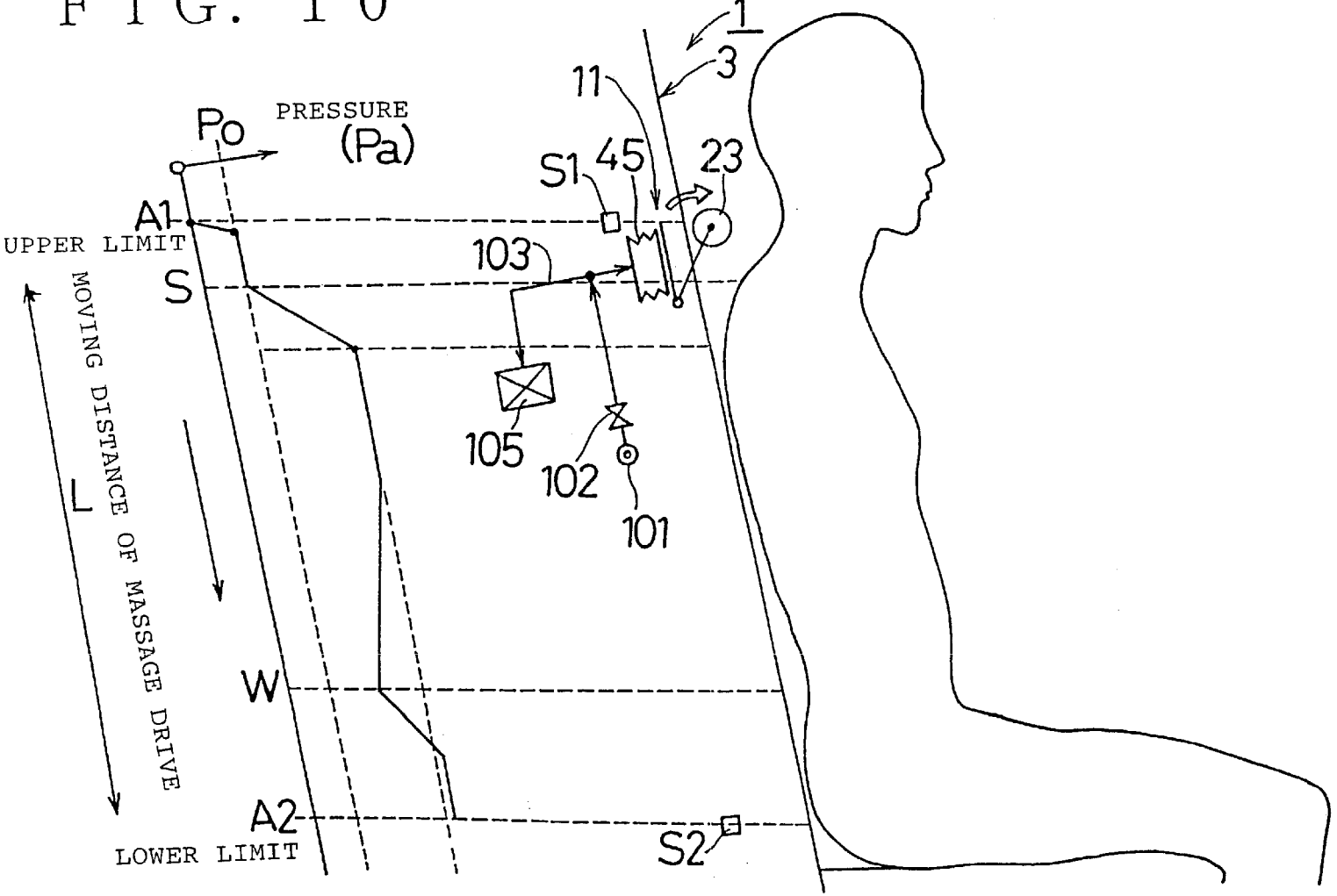
FIG. 10 is a schematic diagram showing a principle construction of the massaging apparatus.

To an air conduit 103 for feeding the compressed air from the air supply source 101 such as a compressor or pump to the aforementioned air cells 45 through a solenoid valve 102, as shown in FIG. 10, there is connected a pressure sensor 105 for detecting the internal pressure of the air cells 45. The internal pressure of the air cells 45 is detected and converted into an electric signal by the pressure sensor 105 and is inputted to a later-described control unit 111. Here, the pressure sensor 105 may be provided either in one pair for the left and right air cells 45L and 45R or only one for either of the left and right air cells 45L and 45R.

As shown in FIG. 10, moreover, an upper limit switch S1 is disposed at an upper limit position A1 of the vertical movement of the massage drive unit 11, and a lower limit switch S2 is disposed at a lower limit position A2. The massage drive unit 11 is so controlled by the later-described control unit 111 that it may move vertically between the upper limit position A1 and the lower limit position A2.

Figure 11:
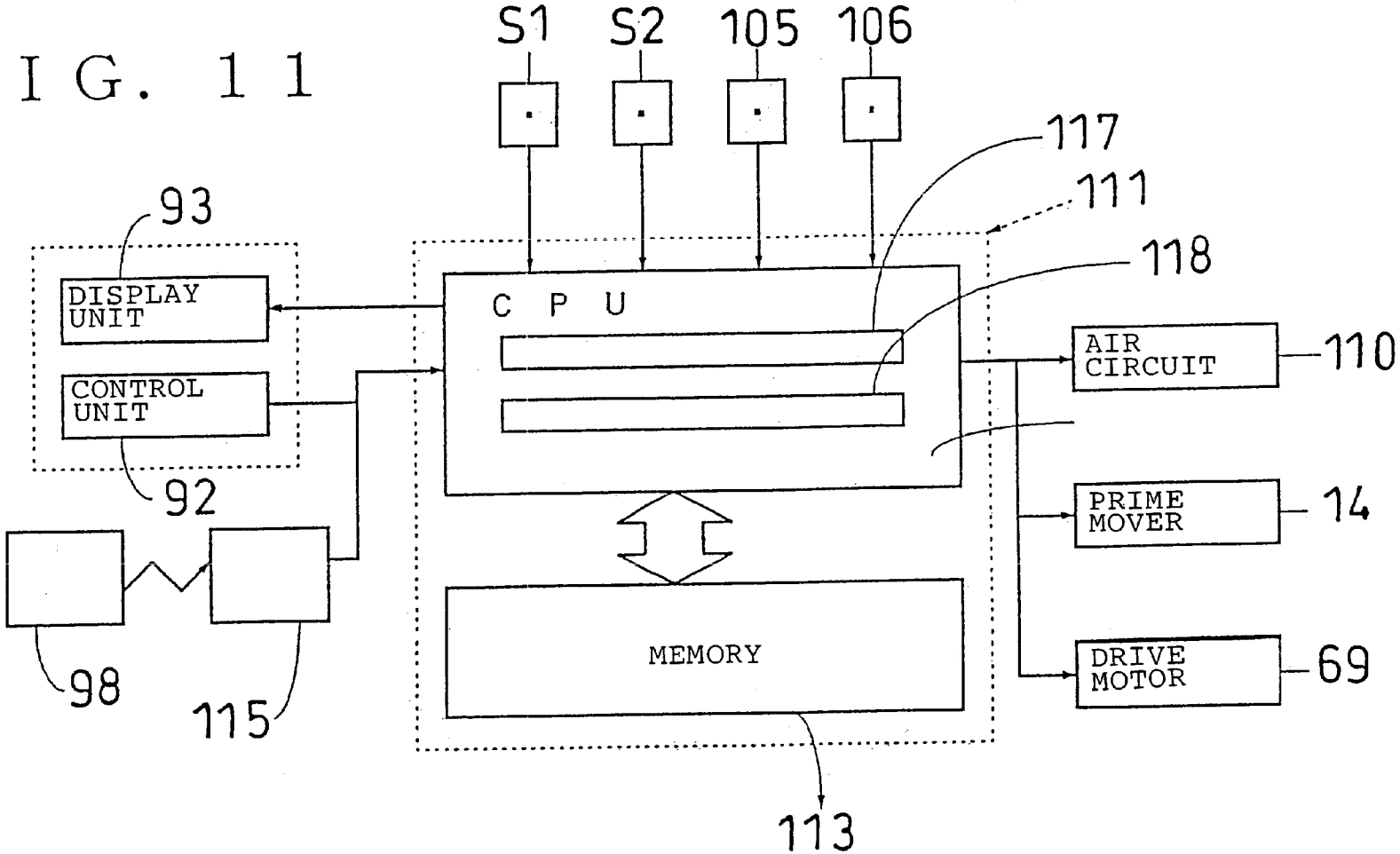
FIG. 11 is a control block diagram of the massaging apparatus.

On the other hand, the rotation of the moving drive unit 9 is detected by a rotation detector 106 shown in FIG. 11. This rotation detector 106 outputs one pulse to the control unit 111 each time the massage drive unit 11 moves vertically 3 mm so that the control unit 111 recognizes the vertical moving position of the massage drive unit 11 by sequentially adding/subtracting the pulses inputted from the rotation detector 106.

FIG. 11 is a control block diagram of the massaging apparatus 1 thus constructed. The control unit 111 comprising a CPU 112 and a memory 113 as main elements is constructed to input the detection signals from the pressure sensor 105, the upper limit switch S1, the lower limit switch S2, the rotation detector 106 and so on and to control an air circuit 110 for operating the air cells 33L and 33R, the air cells 45L and 45R, the air cells 51L and 51R, the air cells 80L and 80R, the air cells 81L and 81R, the air cells 85L and 85R, the air cells 86L and 86R and the air cells 87L and 87R through the valves or the like, the prime mover 14 of the moving drive unit 9, the drive motor 69 and so on. In the control unit 111, on the other hand, the CPU 112 executes the programs stored in the memory 113, to control the air circuit 110 and so on on the basis of the instructions from the control panel 91 or the instructions of the remote control device 98 received by a receiving unit 115. Specifically, the control unit 111 controls the feed/release switching valves in the air circuit 110. Thus, the control unit 111 also functions as the means for executing the massage actions. On the other hand, the control unit 111 controls the screen displays in the display unit 93.

Moreover, the control unit 111 is provided with position discriminating means 117 for discriminating the position of a specific portion (e.g., a shoulder position or a waist position) of the human body of the using person, and effective spot calculating means 118 for calculating the effective spot position of the using person from the specific portion position, as discriminated by the position discriminating means 117, of the human body of the using person. The memory 113 of the control unit 111 is recorded, as enumerated in the following Tables 1 to 6, with the effective spot positions to be massaged according to the treatment course, and treatment contents indicating the massage actions on the spot positions. The treatment contents include the effective spot positions to be massaged according to the treatment course and the massage actions to be made on the spot positions, which are programmed by learning either the treatments, as performed by a chiropractor or a massager, or the clinical cases by the professors or the like of universities investigating the Eastern Medical Science.

(1) Mental Refreshing Course

TABLE 1

● Backbone (◎ and ○ indicate degrees of stimuli)

| Kenchu-Yu/ Hai-Yu | Shin-Yu/ Ketsuin-Yu | Kaku-Yu/ Kan-Yu | Hi-Yu/ Sansho-Yu | Jin-Yu Daicho-Yu | Shocho-Yu/Jiryo |
|---|---|---|---|---|---|
| 2nd Thoratic Vertebra | 5th Thoratic Vertebra | 7th Thoratic Vertebra | 12th Thoratic Vertebra | 3rd Lumbar Vertebra | 2nd Sacral Vertebra |
| ◎ | ◎ | ○ | ○ | ○ | ○ |

● Crotch and Legs

| Kancho | Shofu | Shokin | Saninko/Yoho |
|---|---|---|---|
| ○ | ○ | ◎ | ◎ |

(2) Physical Refreshing Course of Upper Abdomen

TABLE 2

● Backbone (◎ and ○ indicate degrees of stimuli)

| Kenchu-Yu/Hai-Yu | Shin-Yu/Ketsuin-Yu | Kaku-Yu/Kan-Yu | Hi-Yu/Sansho-Yu | Jin-Yu Daicho-Yu | Shocho-Yu/Jiryo |
|---|---|---|---|---|---|
| 2nd Thoratic Vertebra | 5th Thoratic Vertebra | 7th Thoratic Vertebra | 12th Thoratic Vertebra | 3rd Lumbar Vertebra | 2nd Sacral Vertebra |
| ○ | ○ | ◎ | ◎ | ○ | ◎ |

● Crotch and Legs

| Kancho | Shofu | Shokin | Saninko/Yoho |
|---|---|---|---|
| ○ | ○ | ◎ | ◎ |

(3) Physical Refreshing Course of Lower Abdomen

TABLE 3

● Backbone (◎ and ○ indicate degrees of stimuli)

| Kenchu-Yu/Hai-Yu | Shin-Yu/Ketsuin-Yu | Kaku-Yu/Kan-Yu | Hi-Yu/Sansho-Yu | Jin-Yu Daicho-Yu | Shocho-Yu/Jiryo |
|---|---|---|---|---|---|
| 2nd Thoratic Vertebra | 5th Thoratic Vertebra | 7th Thoratic Vertebra | 12th Thoratic Vertebra | 3rd Lumbar Vertebra | 2nd Sacral Vertebra |
| ○ | ○ | ○ | ○ | ◎ | ◎ |

● Crotch and Legs

| Kancho | Shofu | Shokin | Saninko/Yoho |
|---|---|---|---|
| ◎ | ○ | ○ | ◎ |

(4) Waist Muscular Pain Relieving Course

TABLE 4

● Backbone (◎ and ○ indicate degrees of stimuli)

| Kenchu-Yu/Hai-Yu | Shin-Yu/Ketsuin-Yu | Kaku-Yu/Kan-Yu | Hi-Yu/Sansho-Yu | Jin-Yu Daicho-Yu | Shocho-Yu/Jiryo |
|---|---|---|---|---|---|
| 2nd Thoratic Vertebra | 5th Thoratic Vertebra | 7th Thoratic Vertebra | 12th Thoratic Vertebra | 3rd Lumbar Vertebra | 2nd Sacral Vertebra |
| ○ | ○ | ○ | ○ | ◎ | ◎ |

● Crotch and Legs

| Kancho | Shofu | Shokin | Saninko/Yoho |
|---|---|---|---|
| ◎ | ◎ | ○ | ○ |

(5) Leg Muscular Pain Relieving Course

TABLE 5

● Backbone (◎ and ○ indicate degrees of stimuli)

| Kenchu-Yu/Hai-Yu | Shin-Yu/Ketsuin-Yu | Kaku-Yu/Kan-Yu | Hi-Yu/Sansho-Yu | Jin-Yu Daicho-Yu | Shocho-Yu/Jiryo |
|---|---|---|---|---|---|
| 2nd Thoratic Vertebra | 5th Thoratic Vertebra | 7th Thoratic Vertebra | 12th Thoratic Vertebra | 3rd Lumbar Vertebra | 2nd Sacral Vertebra |

TABLE 5-continued

| | | | | | |
|---|---|---|---|---|---|
| ○ | ○ | ○ | ○ | ◎ | ◎ |

● Crotch and Legs

| Kancho | Shofu | Shokin | Saninko/Yoho |
|---|---|---|---|
| ○ | ○ | ◎ | ◎ |

(6) Sciatic Pain Relieving Course

TABLE 6

● Backbone (◎ and ○ indicate degrees of stimuli)

| Kenchu-Yu/Hai-Yu | Shin-Yu/Ketsuin-Yu | Kaku-Yu/Kan-Yu | Hi-Yu/Sansho-Yu | Jin-Yu Daicho-Yu | Shocho-Yu/Jiryo |
|---|---|---|---|---|---|
| 2nd Thoratic Vertebra | 5th Thoratic Vertebra | 7th Thoratic Vertebra | 12th Thoratic Vertebra | 3rd Lumbar Vertebra | 2nd Sacral Vertebra |
| ○ | ○ | ○ | ○ | ◎ | ◎ |

● Crotch and Legs

| Kancho | Shofu | Shokin | Saninko/Yoho |
|---|---|---|---|
| ◎ | ◎ | ○ | ○ |

Figure 15:
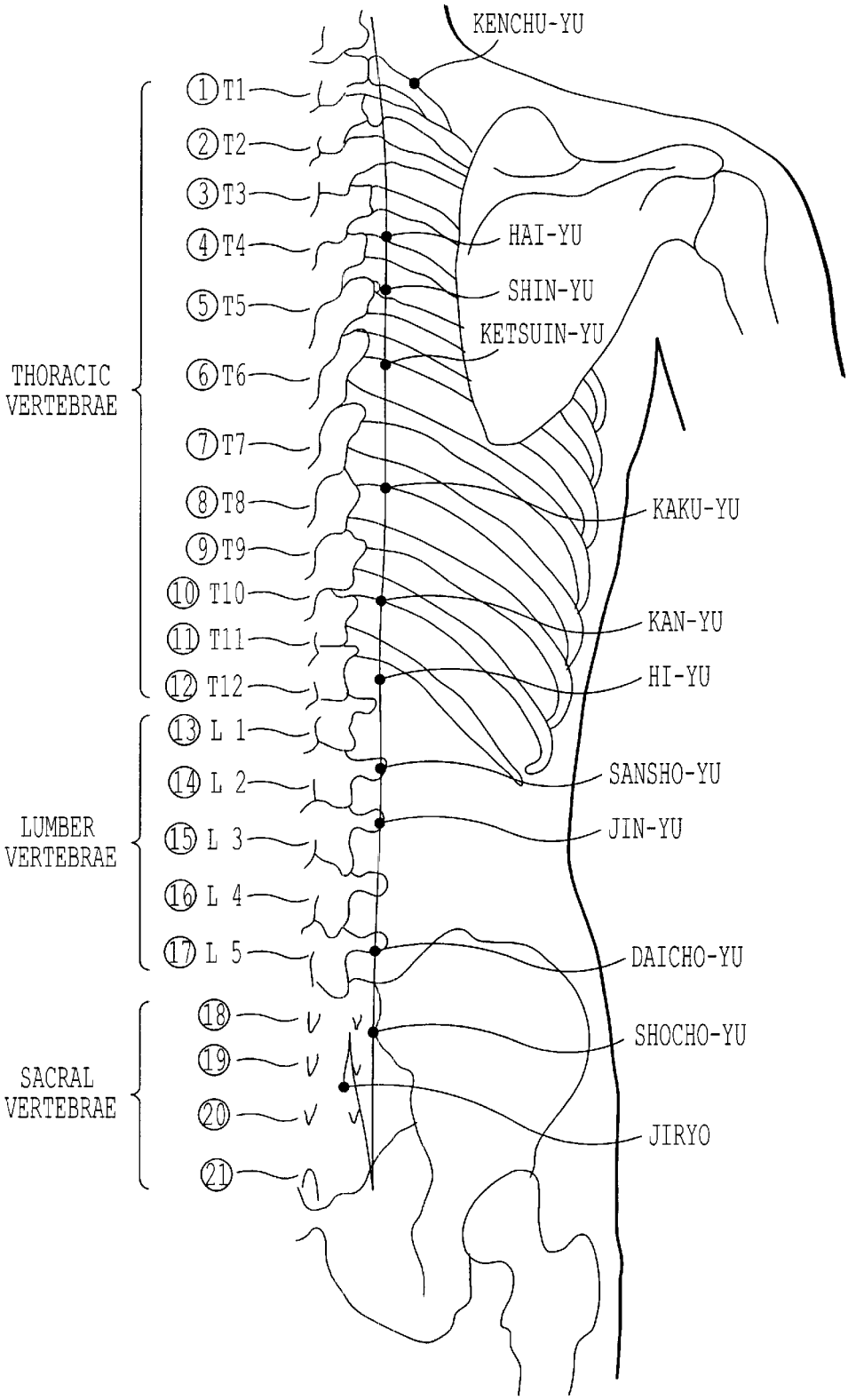
FIG. 15 is a posterior aspect of a trunk showing thoracic vertebrae, lumbar vertebrae, sacral vertebrae, and effective spots of a human body.
Figure 16A:
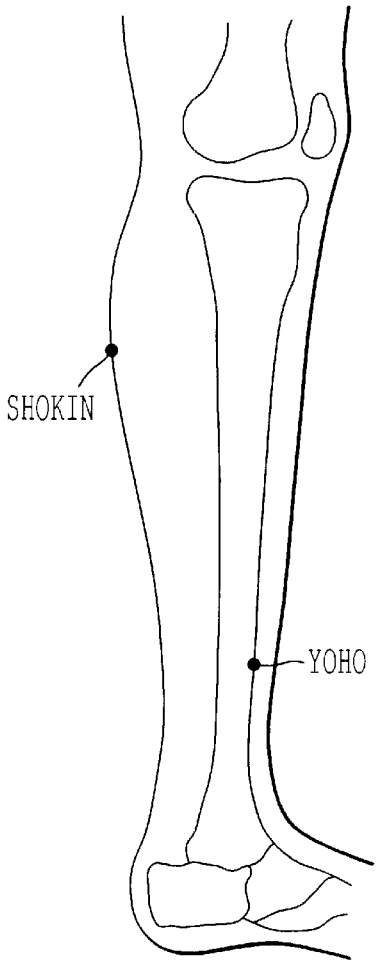
FIG. 16 is a diagram of a lateral aspect and a medial aspect showing effective spots of a lower leg.
Figure 16B:
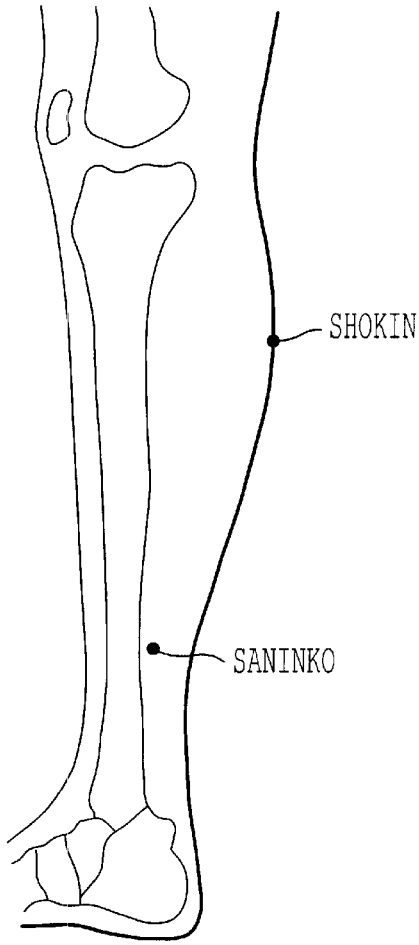

As enumerated in Tables 1 to 6, there are recorded in the memory 113: (1) Mental Refreshing Course; (2) Physical Refreshing Course of Upper Abdomen; (3) Physical Refreshing Course of Lower Abdomen; (4) Waist Muscular Pain Relieving Course; (5) Leg Muscular Pain Relieving Course; and (6) Sciatic Pain Relieving Course. There are further recorded the effective spot positions located along the backbone of the human body, as shown in FIG. 15: the "Kenchu-Yu/Hai-Yu"; the "Shin-Yu/Ketsuin-Yu"; the "Kaku-Yu/Kan-Yu"; the "Hi-Yu/Sansho-Yu"; the "Jin-Yu/Daicho-Yu"; and the "Shocho-Yu/Jiryo". There are further recorded the effective spot positions located on the legs of the human body as shown in FIGS. 16 and 17: "Kancho"; "Shofu"; "Shokin"; and "Saninko/Yoho".

Table 1 shows the treatment contents indicating the effective spot positions to be massaged for the "Mental Refreshing Course" and the massage actions to be applied to the spot positions. Table 2 shows the treatment contents indicating the effective spot positions to be massaged for the "Physical Refreshing Course of Upper Abdomen" and the massage actions to be applied to the spot positions. Table 3 shows the treatment contents indicating the effective spot positions to be massaged for the "Physical Refreshing Course of Lower Abdomen" and the massage actions to be applied to the spot positions. Table 4 shows the treatment contents indicating the effective spot positions to be massaged for the "Waist Muscular Pain Relieving Course" and the massage actions to be applied to the spot positions. Table 5 shows the treatment contents indicating the effective spot positions to be massaged for the "Leg Muscular Pain Relieving Course" and the massage actions to be applied to the spot positions. Table 6 shows the treatment contents indicating the effective spot positions to be massaged for the "Sciatic Pain Relieving Course" and the massage actions to be applied to the spot positions.

In Tables 1 to 6, on the other hand, the contents of the massage actions to be applied to the individual spot positions are indicated by "◎" and "○", as enumerated to correspond to the spot positions. The symbol "◎" means a strong massage, and the symbol "○" means a weak massage. Here, the strong massage is exemplified by a combination of three consecutive pushes made weakly, weakly and strongly by the low-pressure method as a finger-press massage action pattern and three consecutive kneading actions as the kneading massage action pattern. The weak massage is exemplified by a combination of one push made by the ordinary pressure method as the finger-press massage action pattern and one kneading action as the kneading massage action pattern.

The position discriminating means 117 of the control unit 111 performs an initial action to recognize the body shape of the using person when a later-described treatment course or diagnostic inquiry course is selected. For this action, the position discriminating means 117 moves the massage drive unit 11 vertically by two strokes (i.e., reciprocates the rolling actions two times by the massage drive unit 11) along the human body of the using person with the massage member 23 being protruded toward the user by the extensions of the air cells 45L and 45R, to recognize the body shape of the using person from the relations in the strokes between the moving positions of the massage drive unit 11 and the internal pressure of the air cells 45, as detected by the pressure sensor 105, and to discriminate the shoulder position and the waist position, i.e., the specific portions of the body of the using person with respect to the massaging apparatus 1.

First of all, more specifically, the internal pressures of the air cells 45L and 45R are set to a level of about 8,000 Pa (i.e., 0.008 MPa) as the initial action for specifying the body shape of the using person, thereby to extend the air cells 45L and 45R, as shown in FIG. 10, to protrude the upper massage member 23 toward the using person, and the solenoid valve 102 is closed. In this state, the massage drive unit 11 is vertically moved along the body of the using person between the upper limit position A1 and the lower limit position A2 thereby to perform the rolling actions. The changing situations of the moving position of the massage drive unit 11 at this time and the internal pressure of the air cells 45, as detected by the pressure sensor 105, are written in the memory 113 of the control unit 111. As a result, the body shape of the user is recognized from the relations between the moving positions of the massage drive unit 11 and the internal pressures of the air cells 45, as detected by the pressure sensor 105. From the relations between the moving positions of the massage drive unit 11 and the detected internal pressures of the air cells 45, on the other hand, the changing rate of the internal pressure of the air cells with respect to the moving position is calculated and written in the memory 113 of the control unit 111.

Here, the rolling actions are the effective massage actions, in which the longitudinal straight portions called the "Keiraku", existing at an interval of about 70 mm to each other along the backbone in the back of the human body and having the effective spots called the "Keiketsu" arranged are stimulated by the massage member 23. Therefore, these rolling actions are the massage actions which are recommended to be performed prior to the ordinary massages/pats or the like.

For enhancing the precision of the pressure detections and the effects, on the other hand, the rolling actions are ended by reciprocating them two times or so.

Figure 13:
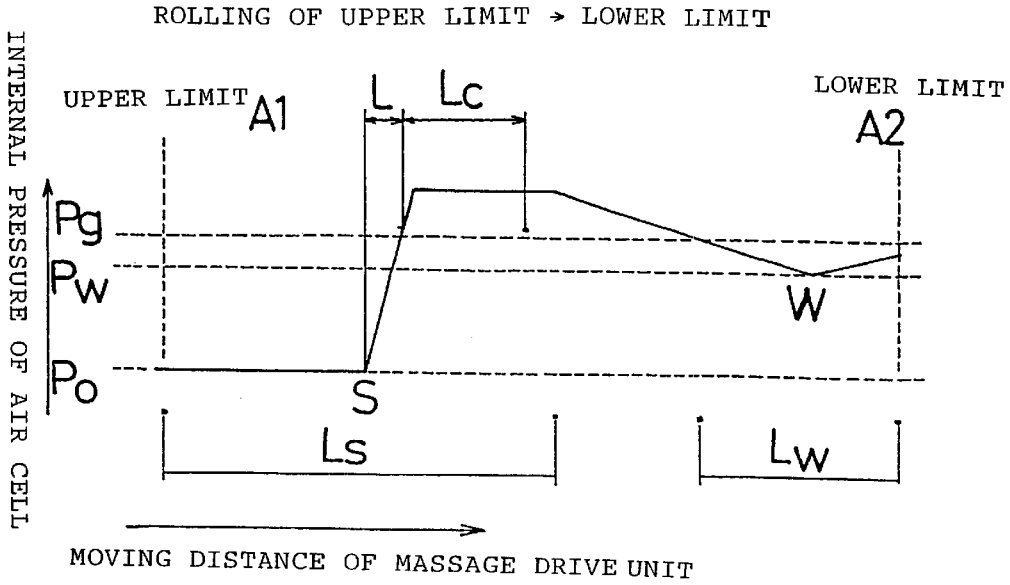
FIG. 13 is a graph illustrating the relation between the moving distance of the massage drive unit and the internal pressure of the air cell in a downward rolling motion.
Figure 14:
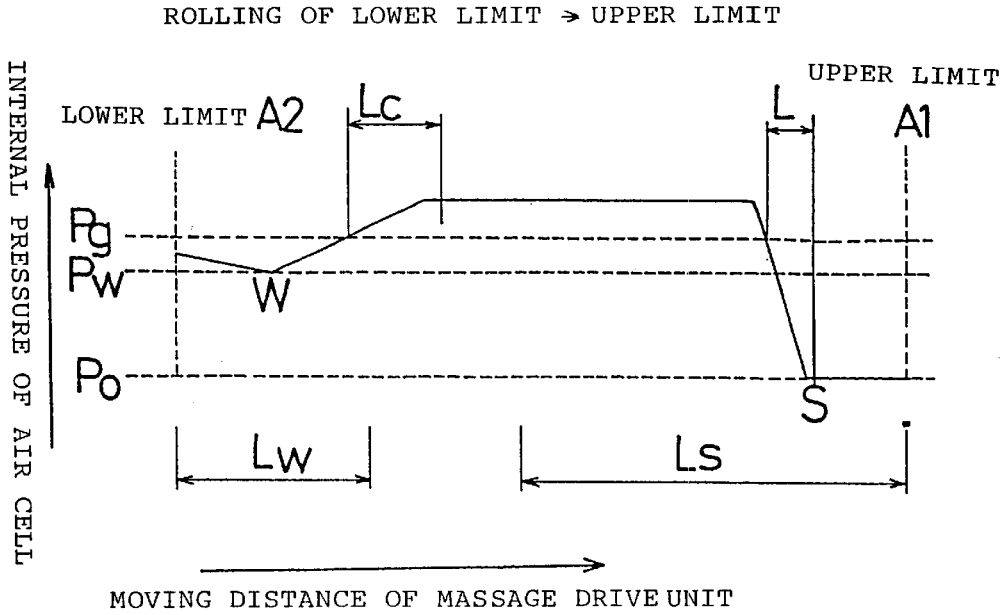
FIG. 14 is a graph illustrating the relation between the moving distance of the massage drive unit and the internal pressure of the air cell in an upward rolling motion.

The pressure data thus obtained with respect to the moving positions of the massage drive unit 11 are shown in FIG. 10, FIG. 13 and FIG. 14.

Here will be described the concept of achieving the changes in the internal pressure of the air cells 45 by loading them.

Figure 12:
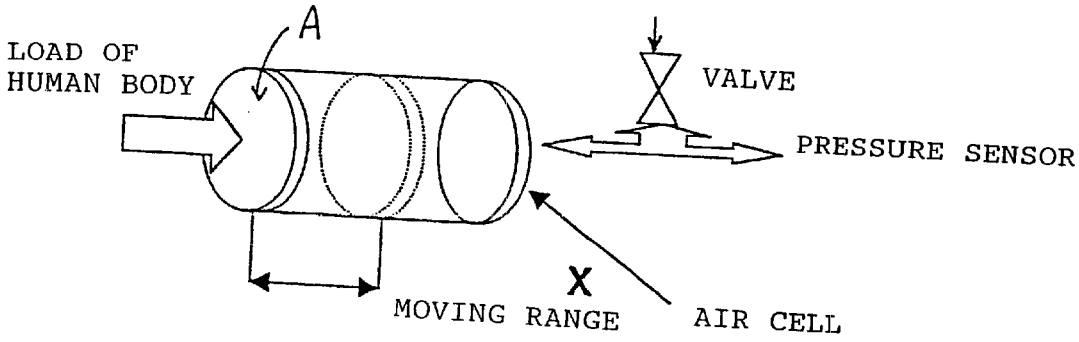
FIG. 12 is a principle diagram showing relations between a load on an air cell and an internal pressure.

When the body load acts on the air cell 45, as shown in FIG. 12, the Formula for the balance of the forces in which the air cell 45 having a sectional area of A $m^2$ is compressed by X m under the internal pressure P (pascals) of the air cell 45 is expressed as follows:

$$\begin{aligned}\text{Work } W(J) &= P \times A \times X \\ &= P \times (A \times X) \\ &= P \times V(J).\end{aligned}$$

Hence, the formula for determining the internal pressure P for V=constant is given by modifying the above Formula:

$$P = W/V \text{ (Pa, } N/m^2\text{)}.$$

This pressure change is converted into an electric signal by the pressure sensor 105.

In FIG. 13, letters Po, Pg, L, Lc, Ls and Lw designate preset constants for discriminating the shoulder position and the waist position when the massage drive unit 11 performs the downward rolling action. The constant Po is an initial pressure of the air cells 45 and is set at about 8,000 Pa (or 0.008 MPa), as described hereinbefore. The constant Pg is a threshold value of the internal pressure of the air cell 45. The constant L is a range for confirming that a position S is located at the shoulder position, and is set at a predetermined distance downward from the position S at which the internal pressure of the air cell 45 starts to rise from the initial pressure Po. The constant Lc is a range for eliminating the erroneous detection, as caused by disturbances, of the shoulder position, and is set at a predetermined distance downward from the lower end of the range L. The constant Ls is a range in which the shoulders are normally considered to exist, and is set at a predetermined distance downward from the upper limit position A1. The constant Lw is a range in which the waist is normally considered to exist, and is set at a predetermined distance upward from the lower limit position A2.

Moreover, the control unit 111 is constructed to discriminate the shoulder position and the waist position in the following manners in the downward rolling actions where the massage drive unit 11 moves from the upper limit position A1 to the lower limit position A2, as shown in FIG. 13.

Specifically, the shoulder position is discriminated to be located at the position S where the internal pressure of the air cell 45 starts to rise from the initial pressure Po while the massage drive unit 11 is moving downward within the range Ls. On the other hand, the waist position is discriminated to be located at the position W where the internal pressure of the air cell 45 takes the lowest level after the downward movement of the massage drive unit 11 exceeded the range Lc.

However, the shoulder position detection error is recognized: (1) where the internal pressure of the air cell 45 has not risen from the initial pressure Po while the massage drive unit 11 is moving downward within the range Ls; (2) where the internal pressure of the air cell 45 has not exceeded the threshold value Pg while the massage drive unit 11 is moving downward from the position S within the range L; and (3) where the internal pressure of the air cell 45 has not keep a pressure over the threshold value Pg while the massage drive unit 11 is moving downward within the range Lc.

On the other hand, the waist position detection error is recognized: (1) where the shoulder position cannot be detected; and (2) where the internal pressure of the air cell 45 has not become the threshold value Pg or less before the massage drive unit 11 reaches the lower limit position A2 over the range Lc.

In FIG. 14, the letters Po, Pg, L, Lc, Ls and Lw designate preset constants for discriminating the shoulder position and the waist position when the massage drive unit 11 performs the upward rolling action. The constant Po is an initial pressure of the air cells 45 and is set at about 8,000 Pa (or 0.008 MPa), as described hereinbefore. The constant Pg is a threshold value of the internal pressure of the air cell 45. The constant L is a range for confirming that the position S is located at the shoulder position, and is set at a predetermined distance upward from the position at which the internal pressure of the air cell 45 has dropped to the threshold value Pg. The constant Lc is a range for eliminating the erroneous detection, as caused by disturbances, of the waist position, and is set at a predetermined distance upward from the position at which the internal pressure of the air cell 45 has risen to the threshold value Pg. The constant Ls is a range in which the shoulders are normally considered to exist, and is set at a predetermined distance upward from the upper limit position A1. The constant Lw is a range in which the shoulders are normally considered to exist, and is set at a predetermined distance downward from the lower limit position A2.

Moreover, the control unit is constructed to discriminate the shoulder position and the waist position in the following manners in the upward rolling actions where the massage drive unit 11 moves from the lower limit position A2 to the upper limit position A1, as shown in FIG. 14.

Specifically, the waist position is discriminated to be located at the position W where the internal pressure of the air cell 45 exhibits the lowest pressure Pw before the internal pressure of the air cell 45 exceeds the threshold value Pg. On the other hand, the shoulder position is discriminated to be located at the positions S where the internal pressure of the air cell 45 restores the initial position Po after the upward movement of the massage drive unit 11 exceeded the range Lc.

However, the waist position detection error is recognized: (1) where the threshold value Pg is not exceeded while the massage drive unit 11 is moving upward within the range Lw; and (2) where the internal pressure of the air cell 45 has not kept a pressure higher than the threshold value Pg while the massage drive unit 11 is moving upward within the range Lc.

On the other hand, the shoulder position detection error is recognized: (1) where the waist position cannot be detected; (2) where the internal pressure of the air cell 45 has become lower than the threshold value Pg while the massage drive unit 11 is moving upward within a range other than the range Ls over the range Lc; (3) where the internal pressure of the air cell 45 has not become lower than the threshold value Pg while the massage drive unit 11 is moving upward within the range Ls; and (4) where the internal pressure of the air cell 45 has not returned to the initial value Po while the massage drive unit 11 is moving upward within the range L.

Here, the individual lengths of the ranges L, Lc, Ls and Lw in FIGS. 13 and 14 may be set to either equal or different values which are suited for the downward rolling actions and the upward rolling actions.

The effective spot calculating means 118 of the control unit 111 calculates the positions of the effective spots along the backbone of the human body, i.e., the "Kenchu-Yu/Hai-Yu"; the "Shin-Yu/Ketsuin-Yu"; the "Kaku-Yu/Kan-Yu"; the "Hi-Yu/Sansho-Yu"; the "Jin-Yu/Daicho-Yu"; and the "Shocho-Yu/Jiryo" from the shoulder position discriminated by the position discriminating means 117, in the following manners.

Figure 18:
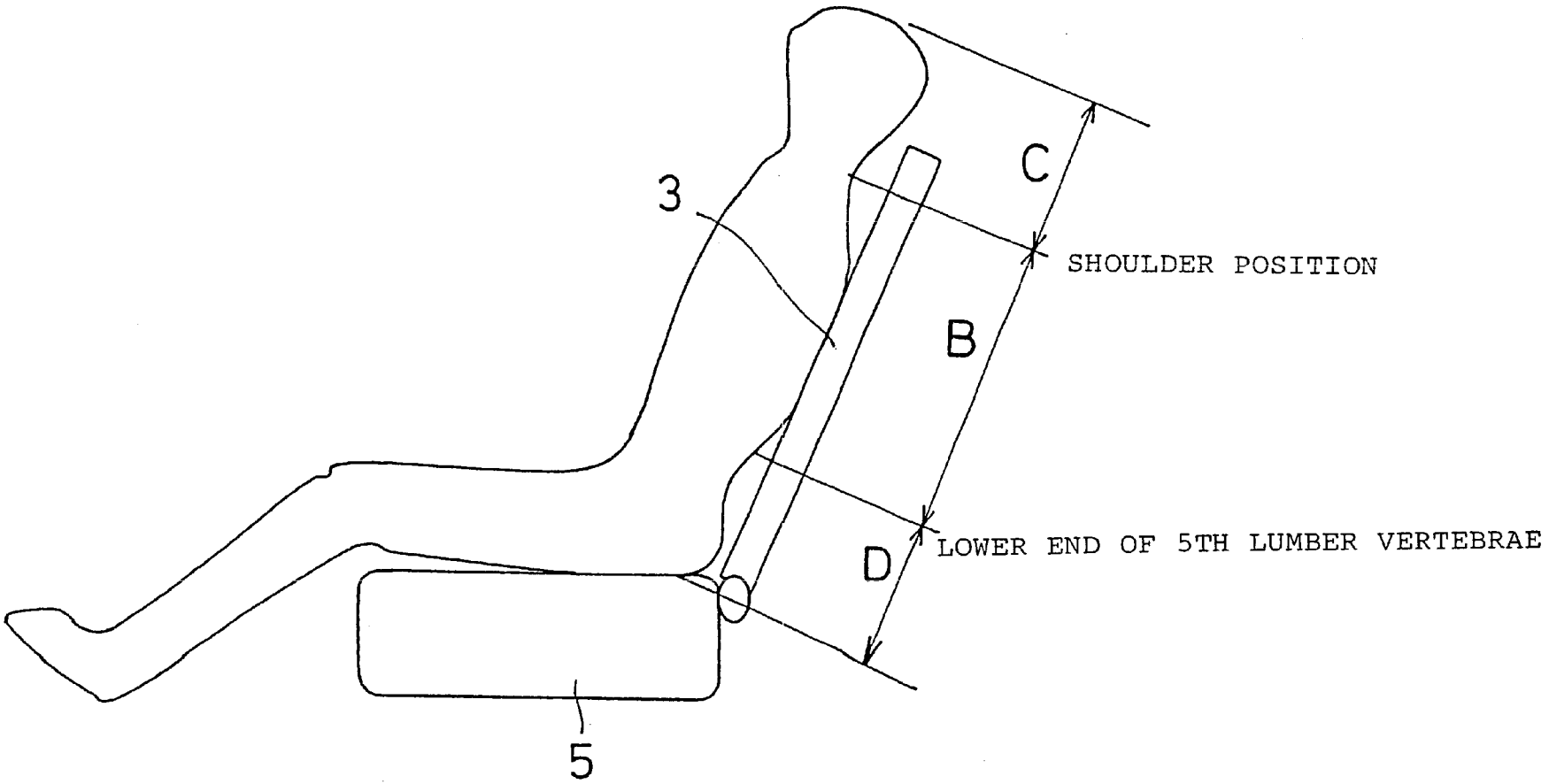
FIG. 18 is a side elevation showing a relation between the massaging apparatus, and a shoulder position and the position of a fifth lumbar vertebra.

Along the backbone of the human body, as shown in Posterior Aspect of Trunk in FIG. 15, there are arranged at a substantially equal interval twelve thoracic vertebrae, five thoratic vertebrae and four sacral vertebrae. The shoulder position, as discriminated by the position discriminating means 117 while the using person is sitting on the body of the massaging apparatus 1, is located at the upper end of the first thoracic vertebra. In FIG. 18, on the other hand, letter D indicates the distance from the seat portion 5 of the massaging apparatus 1 to the lower end of the fifth lumber vertebra, and letter B indicates the distance from the shoulder position to the lower end of the fifth lumber vertebra. The distance D is estimated to be a constant value of about 15 cm irrespective of difference in the body shape such as difference in height of the using person, and the twelve thoracic vertebrae and the five lumber vertebrae are equidistantly arranged in the distance B. If the shoulder position is discriminated, therefore, the distance [B+D] from the seat portion 5 of the massaging apparatus 1 to the shoulder position can be calculated. Since the distance D is 15 cm, the distance B may be calculated by subtracting 15 cm from the distance [B+D] from the seat portion 5 to the shoulder position, that is, by the calculation of [B+D−15]. The vertical width ΔB of one of the thoracic vertebrae, the lumber vertebrae and the sacral vertebrae of the using person can be calculated by [B/(12+5)=ΔB]. Moreover, the lower end position or the upper end position of each thoracic vertebra or thoratic vertebra can be calculated.

As the massage actions of each effective spot position, moreover, the pointing actions are performed by repeating the massage actions in which the massage members 23 and 25 of the massage drive unit 11 are vertically moved with a vertical width of several centimeters (about 3 cm). Considering that the portion of the human body to be pushed by the massage members 23 and 25 has a certain size, the spot position of the "Kenchu-Yu/Hai-Yu" is located at the lower end position of the second thoracic vertebra; the spot position of the "Shin-Yu/Ketsuin-Yu" is located at the lower end position of the fifth thoracic vertebra; the spot position of the "Kaku-Yu/Kan-Yu" is located at the lower end position of the seventh thoracic vertebra; and the spot position of the "Hi-Yu/Sansho-Yu" is located at the lower end position of the twelfth thoracic vertebra, as seen from FIG. 15. On the other hand, the spot position of the "Jin-Yu/Daicho-Yu" is located at the lower end position of the third lumber vertebra. On the other hand, the spot position of the "Shocho-Yu/Jiryo" is located at the lower end position of the second sacral vertebra. As a result, the individual spots are located at the positions which are moved downward from the shoulder position by the length calculated by multiplying the determined vertical width ΔB by the number of the corresponding individual thoracic vertebrae, lumber vertebrae and sacral vertebrae.

Specifically: the spot of the "Kenchu-Yu/Hai-Yu" is located at the position which is moved downward from the shoulder position by a length of [ΔB×2]; the spot of the "Shin-Yu/Ketsuin-Yu" is located at the position which is moved downward from the shoulder position by a length of [ΔB×5]; the spot of the "Kaku-Yu/Kan-Yu" is located at the position which is moved downward from the shoulder position by a length of [ΔB×7]; and the spot of the "Hi-Yu/Sansho-Yu" is located at the position which is moved downward from the shoulder position by a length of [ΔB×12]. On the other hand, the spot of the "Jin-Yu/Daicho-Yu"

is located at the position which is moved downward from the shoulder position by a length of [ΔB×15]. On the other hand, the spot of the "Shocho-Yu/Jiryo" is located at the position which is moved downward from the shoulder position by a length of [ΔB×19].

By the calculations thus far described, therefore, the effective spot calculating means 118 of the control unit 111 calculates in advance, from the discriminated shoulder position, the individual spot positions of: the "Kenchu-Yu/Hai-Yu"; the "Shin-Yu/Ketsuin-Yu"; the "Kaku-Yu/Kan-Yu"; the "Hi-Yu/Sansho-Yu"; the "Jin-Yu/Daicho-Yu"; and the "Shocho-Yu/Jiryo".

Where the massage actions according to the treatment course such as the mental refreshing course are to be executed, moreover, the control unit 111 reads out at first the treatment contents corresponding to the treatment course from the memory 113, and then controls the massage members 23 and 25 of the massage drive unit 11 to perform the massage actions of the treatment contents read out from the memory, while moving the massage members 23 and 25 to the individual spot positions along the backbone of the human body, as calculated by the effective spot calculating means 118, in accordance with the treatment contents read out. When the massage actions on the individual spot positions along the backbone of the human body, as corresponding to the treatment course, are ended, the control unit 111 controls the air circuit 110 in accordance with the read treatment contents, to massage the effective spots in the lower body, i.e., the "Kancho", the "Shofu", the "Shokin" and the "Saninko/Yoho" sequentially with the massage members or individual air cells 80, 81, 85, 86 and 87.

Where the mental refreshing course is selected as the treatment course or set by the later-described diagnostic inquiry, more specifically, the effective spots along the backbone of the human body, i.e., the "Kenchu-Yu/Hai-Yu"; the "Shin-Yu/Ketsuin-Yu"; the "Kaku-Yu/Kan-Yu"; the "Hi-Yu/Sansho-Yu"; the "Jin-Yu/Daicho-Yu"; and the "Shocho-Yu/Jiryo" are sequentially massaged, as enumerated in Table 1, by the massage members 23 and 25 of the massage drive unit 11. After this, the effective spots in the legs of the human body, i.e., the "Kancho", the "Shofu", the "Shokin" and the "Saninko/Yoho" are sequentially massaged by the massage members, i.e., the air cells 80L and 80R, the air cells 81L and 81R, the air cells 85L and 85R, the air cells 86L and 86R and the air cells 87L and 87R.

At this time, by the massage members 23 and 25 of the massage drive unit 11, the "Kenchu-Yu/Hai-Yu" and the "Shin-Yu/Ketsuin-Yu" are strongly massaged, whereas the "Kaku-Yu/Kan-Yu", the "Hi-Yu/Sansho-Yu", the "Jin-Yu/Daicho-Yu" and the "Shocho-Yu/Jiryo" are weakly massaged. By the air cells 80L and 80R, the air cells 81L and 81R, the air cells 85L and 85R, the air cells 86L and 86R and the air cells 87L and 87R, on the other hand, the "Shokin" and the "Saninko/Yoho" are strongly massaged, whereas the "Kancho" and the "Shofu" are weakly massaged.

Figure 19:
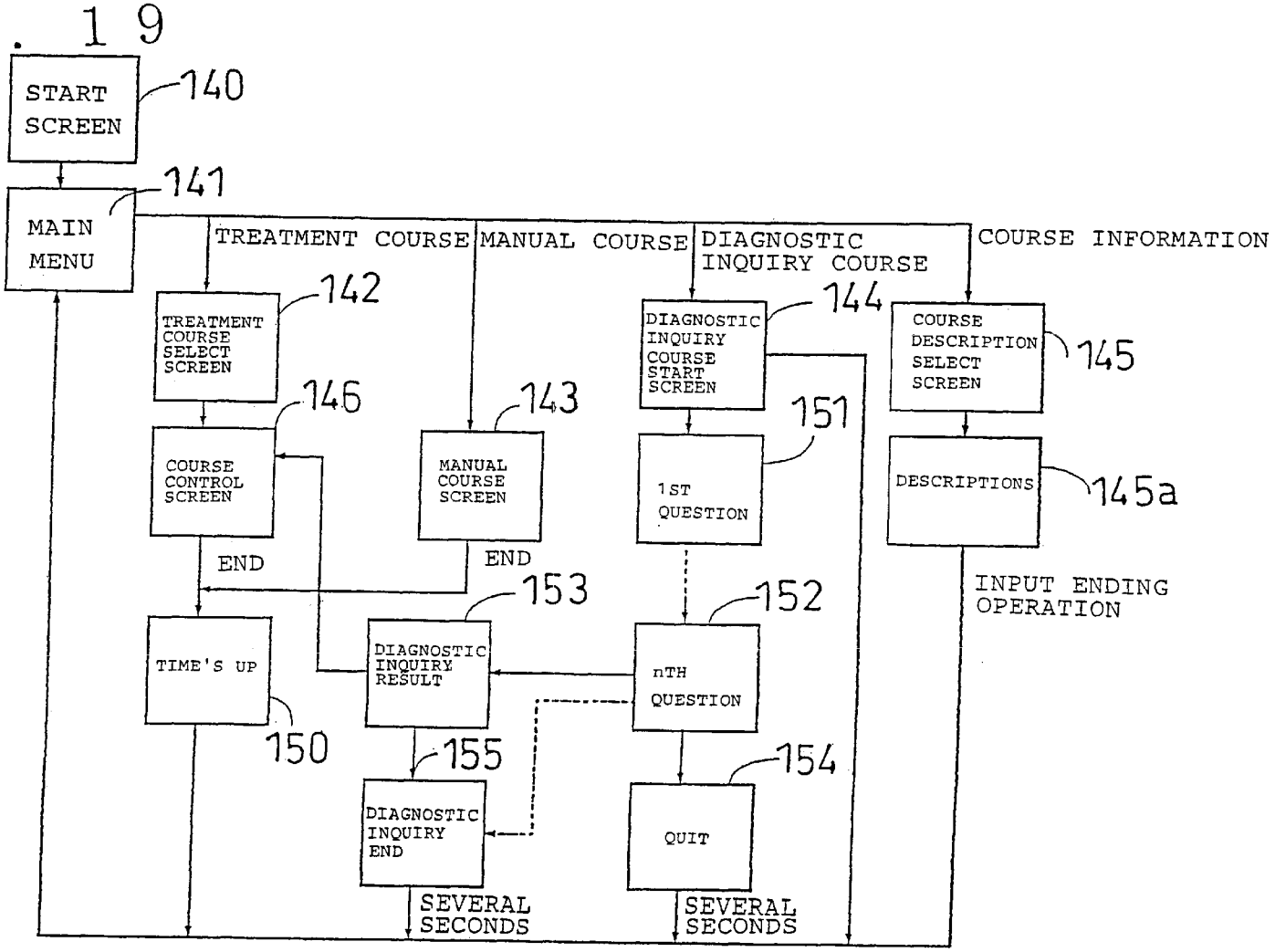
FIG. 19 is a display state transition diagram of a display unit.

FIG. 19 is a transition diagram of the screens to be displayed in the display unit 93 where the massaging apparatus 1 is controlled by the control panel 91.

First of all, when the power switch 94 of the control unit 92 is turned ON, a start screen 140 is displayed in the display unit 93. This start screen 140 is displayed (for about 3 seconds) till the massage drive unit 11 moves to the upper limit position A1.

Figure 20:
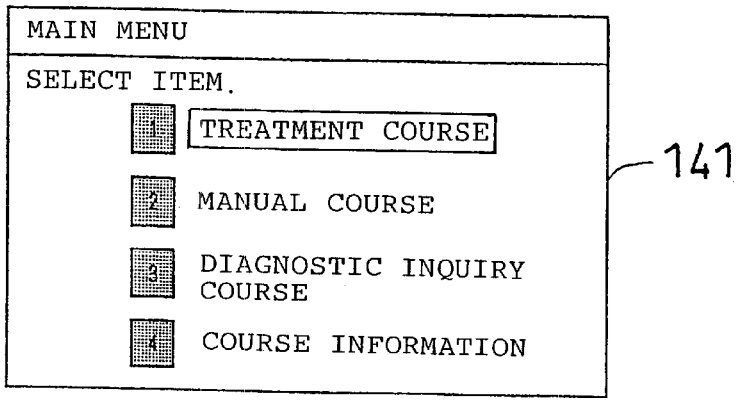
FIG. 20 presents screens to be displayed by the display unit and showing a main menu at (a), a treatment course select screen at (b) and a course control screen at (c)
Figure 20:
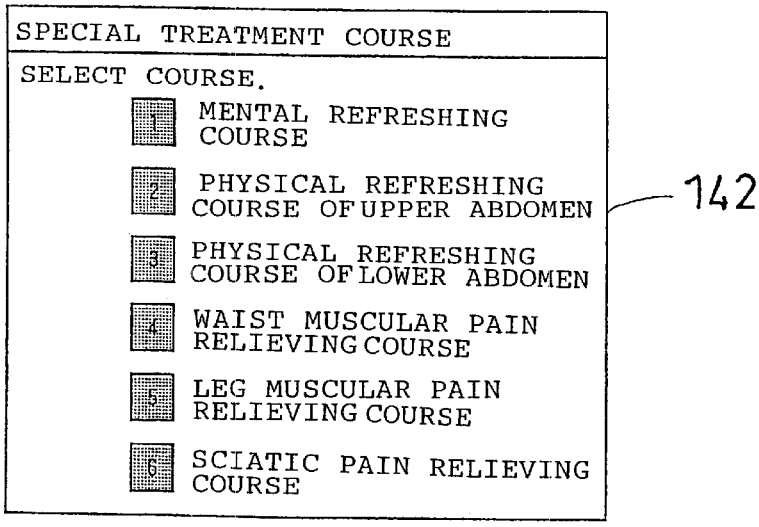
Figure 20:
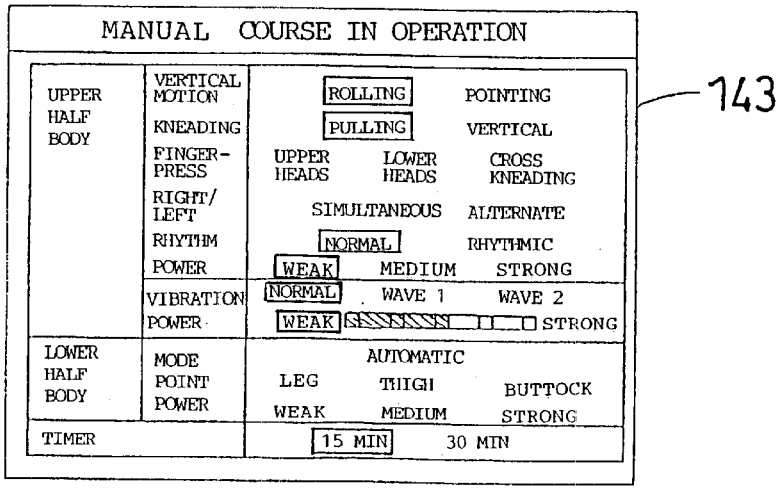

Next, there is displayed in the display unit 93 a main menu 141, as shown in FIG. 20(*a*). In this main menu 141, four items can be selected. This selection is performed by the individual switches 95, 96 and 97. Here, the item selected is highlighted.

Figure 21:
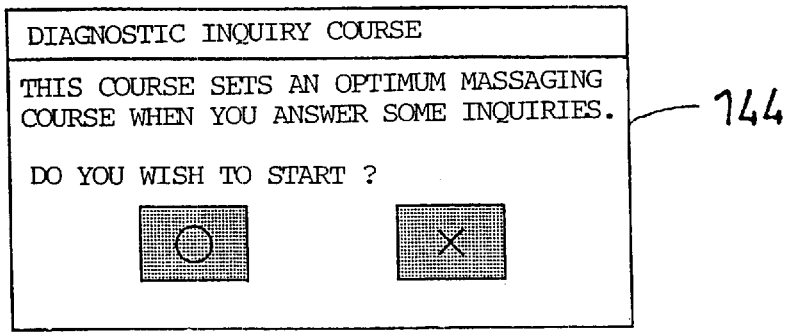
FIG. 21 presents screens to be displayed by the display unit and showing a diagnostic inquiry course starting screen at (a), a course description select screen at (b) and a course control screen at (c)
Figure 21:
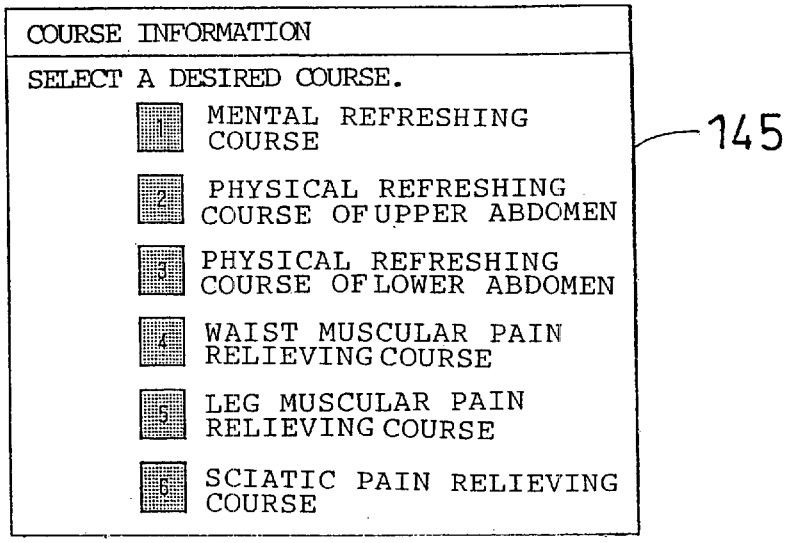
Figure 21:
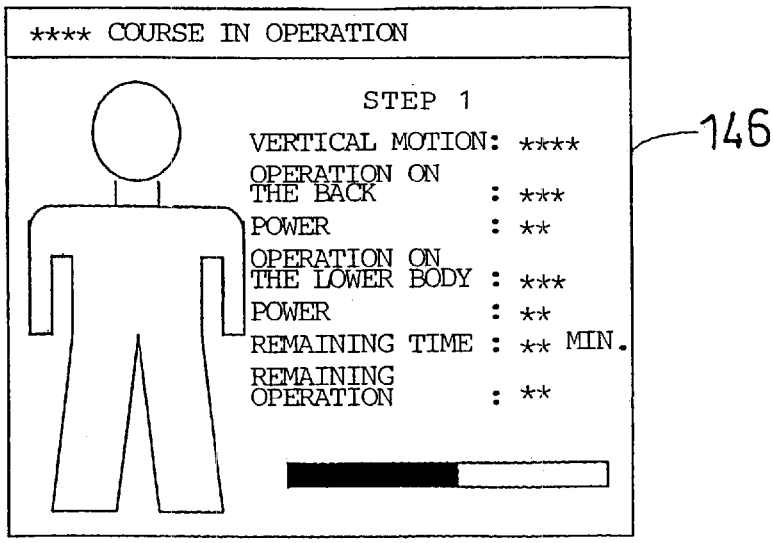

If the first item "Treatment Course" is selected in the main menu 141, there is displayed a treatment course select screen 142, as shown in FIG. 20(*b*). The treatment course is a massage course which is performed with a predetermined treatment object such as the shown course name, and the memory 113 is stored with the program data which determine a series of massage procedures according to each treatment object. If one treatment course is selected in the select screen 142, it is executed by the control unit 111 so that the predetermined massage actions are performed. While the treatment course is being executed, on the other hand, a course control screen 146, as shown in FIG. 21(*c*), is displayed in the display unit 93 to indicate the acting state and the remaining time of the course.

If the second item "Manual Course" is selected in the main menu 141, there is displayed a manual action screen 143, as shown in FIG. 20(*c*). In the manual course, the massages are performed by instructing the massage actions manually by the massage members 23 and 25 and the individual air cells 80, 81, 85, 86 and 87 of the individual massage drive unit 11, and the manual action screen 143 displays the acting situations so that the massage actions can be changed by changing the displays with the individual switches of the control unit 92.

When both the treatment course and the manual course are ended in their actions, the ends are displayed in a time's up screen 150, and the main menu 141 is restored several seconds later.

Here, the remote control device 98 is provided with: switches 147 having functions similar to those of the switches of the control unit 92; treatment course switches 148 for selecting the courses of the same contents as those of the items displayed in the treatment course select screen 142 without using the treatment course select screen 142; and manual course switches 149 for instructing the actions without using the manual action screen 143.

If the third item "Diagnostic Inquiry Course" is selected in the main menu 141, there is displayed a diagnostic inquiry course start screen 144, as shown in FIG. 21(*a*). The diagnostic inquiry course is provided for asking a question to the using person so that the physical condition of the using person may be decided by the answer to set the massage course according to the physical condition. This diagnostic inquiry course will be described in detail hereinafter.

If the fourth item "Course Information" is selected in the main menu 141, there is displayed a course description select screen 145, as shown in FIG. 21(*b*). The course information is concerned with the information on the treatment course. If a treatment course is selected in the screen 145, there is displayed a description 145*a* (e.g., "Physical Refreshing Course is * * *.") on the contents of each treatment course.

The questions in the diagnostic inquiry courses are of such an alternative type as can be answered by "YES" (corresponding to the decide switch 96) or "NO" (corresponding to the cancel switch 97), as shown in FIG. 22(*a*) and FIG. 22(*b*). In addition to the shown ones, the contents of the diagnostic inquiry can include: (1) Sex ?; (2) Menstrual Pain ?; (3) Headache ?; (4) Eye Fatigue ?; (5) Back Tensed ?; (6) Lumbago ?; (7) Hip Ache ?; (8) Calf Tensed ?; (9) Sensitive to Cold ?; (10) Shin Tensed ?; (11) Face Swollen in the Morning ?; (12) Frequently Thirsty ?; (13) Frequently Take Cold ?; (14) Stomach Ache or Heavy ?; (15) Side Ache or Heavy ?; (16) Underbelley Ache or Heavy; (17) Constipated ?; and (18) Loose Bowels ?.

These questions are displayed in the display unit 93, and their displays are controlled by the control unit 111. In short, the display unit 93 and the control unit 111 function as the diagnostic inquiry means.

Here, these questions are illustrative but not limitative. Specifically, the contents of the diagnostic inquiry can include various questions: (a) items to be confirmed, such as age, height and weight; (b) physical condition at present; (c) the latest physical condition; and (d) items having no relation to the physical conditions, such as searches for the latent tendencies unrecognized by the using person. The contents may contain the clinical history.

The using person answers the individual questions with the decide switch 96 or the cancel switch 97 of the control unit 92. In short, the control unit 92 functions as the input means for inputting the answer of the using person to the diagnostic inquiry.

The control unit 111 sets a treatment course proper for the using person, on the basis of the information obtained by the answer to the question. For setting the treatment course, the physical condition of the using person is decided at first by the control unit 111 on the basis of the information obtained from the answer. Then, the control unit 111 selects and sets the optimum one for improving the physical condition from the plurality of treatment courses.

This will be explained by a simple case. When the using person answers "YES" to a question on the lumbago in the diagnostic inquiry, the user's condition is diagnosed as lumbago. Then, the course selected is the waist muscular pain relieving course for the lumbago. Here, the decision is not limited to such simple case but is synthetically made on the basis of a plurality of questions.

Thus, the control unit 111 also functions not only as the decision means for deciding the physical condition of the using person on the basis of his or her answer but also as the setting means for setting the contents of the massage to be executed, on the basis of the decision result of the physical condition. Here in this embodiment, the decision means or the setting means are constructed to include the computer programs for realizing those functions and the control unit 111 for executing the programs, but may be individually constructed of electronic circuits having equivalent functions.

Figure 23:
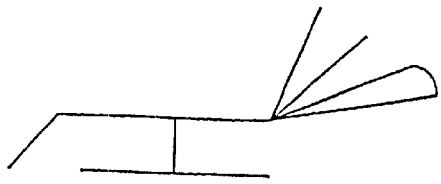
FIG. 23 presents screens to be displayed by the display unit and showing a use quitting screen at (a), a diagnostic inquiry ending screen at (b) and an electric reclining screen at (c)
Figure 24:
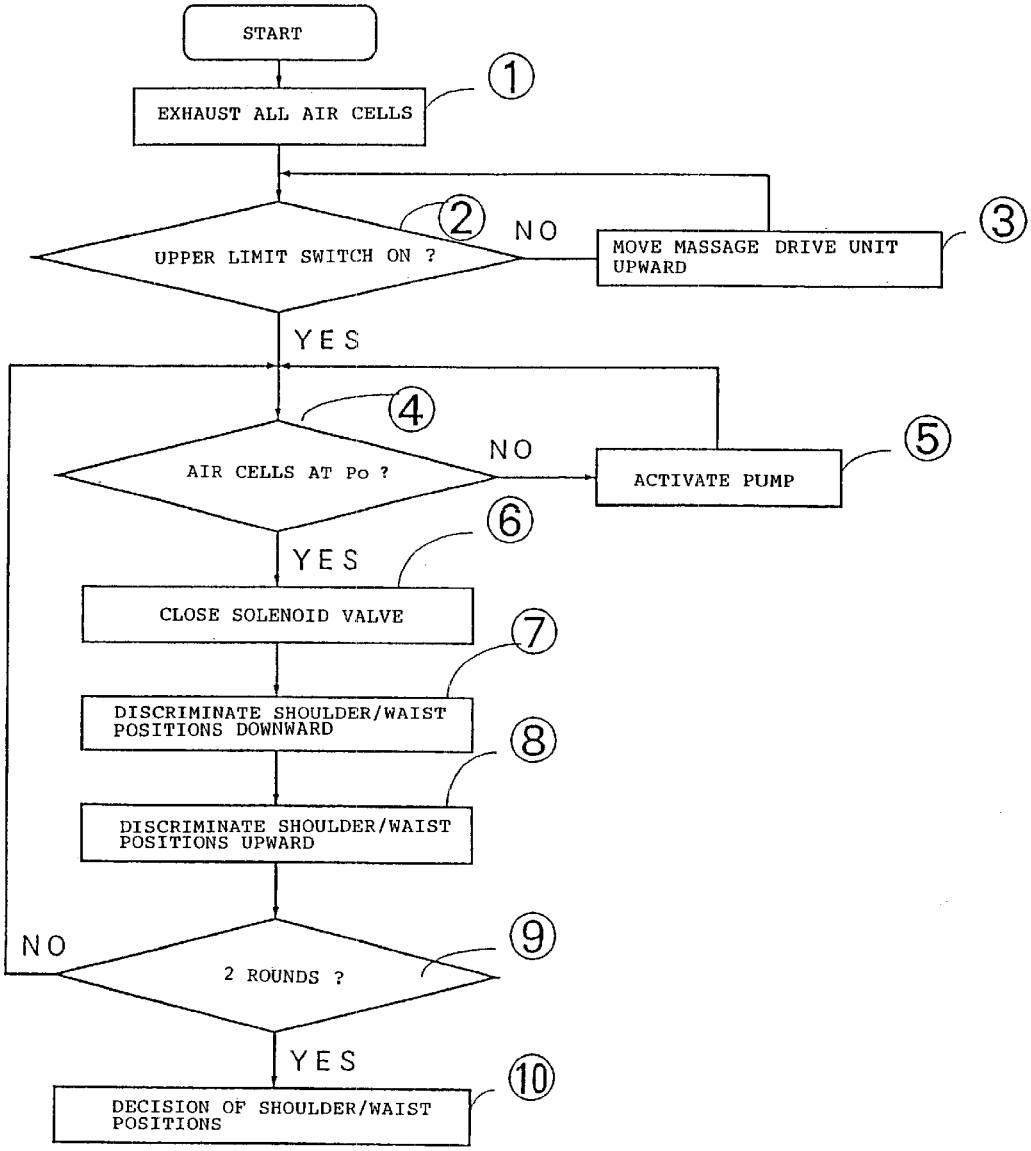
FIG. 24 is a flow chart showing basic controls of rolling actions.

On the other hand, the control means 111 acting as the decision means decides whether or not the physical condition of the using person is in the condition in which the massage should be inhibited. This decision is made on the basis of a diagnostic inquiry 152 having the contents shown in FIG. 22(*c*). Where the using person answers YES to any of the states, as enumerated in the diagnostic inquiry screen 152, the control unit 111 decides that the using person is in the massage inhibiting condition. In the case of the decision of the massage inhibiting condition, the control unit 111 or the setting means does not set any course but displays a quit screen 154 for advising the quit, as shown in FIG. 23(*a*), and the main menu 141 is restored several seconds later.

Here, the question for deciding the massage inhibiting condition, as shown in FIG. 22(*c*), is preferably made first of all a series of questions. If it is asked at first whether or not the using person is in the massage inhibiting condition, the diagnostic inquiry can be quit without any other questions if the answer is YES, and the quit screen 154 is efficiently displayed.

When a series of n-questions for the diagnostic inquiry are ended, the physical condition of the using person is decided while setting the treatment course, and a diagnostic inquiry result screen 153, as shown in FIG. 22(*c*), is outputted to the display unit 93. This diagnostic inquiry result screen 153 displays the physical condition (or healthy condition) of the using person. This is the physical condition outputting means of the invention. By this physical condition outputting function, the using person can be informed of his or her physical condition.

In the diagnostic inquiry result screen 153, there is made a display asking whether or not the set treatment course is to be executed.

When the execution of the set treatment course is selected, the control unit 111 or the massage executing means starts the execution of the set treatment course, and the course control screen 146 is displayed as in the case where the treatment course is manually selected.

Where the execution of the set treatment course is not selected, a diagnostic inquiry ending screen 155, as shown in FIG. 23(*b*), is displayed, and the main menu 141 is restored several seconds later. Thus, the diagnostic inquiry function could be exclusively utilized without any practical massage.

In the course of the serial questions for the diagnostic inquiry, on the other hand, the display could also be shifted to the diagnostic inquiry ending screen 155 by making the ending control in the control unit 92. In this case, the diagnostic inquiry could be interrupted.

Here in the present massaging apparatus 1, the back portion 3 can be freely reclined, as described hereinbefore. The control unit 111 is constructed to interrupt the massage actions by the air cells 3 (or the massage means) while the back portion 3 is being reclined.

Specifically, the reclining is executed by controlling the not-shown reclining execution control unit (or the switch). When this reclining is executed, the control unit 111 (or its CPU 112) for controlling the actions of the air cells is interrupted to interrupt the massage actions, and a reclining screen 156, as shown in FIG. 23(*c*), is displayed in the display unit 93 to inform the using person of the interruption. When the reclining is ended, the display unit 93 restores the display before the reclining is started, so that the massage actions are resumed.

During the reclining, the using person is in an unstable state since the load and position of the using person on the back portion 3 are variable. Therefore, the massage can be stably executed while avoiding the unstable state of the using person, by avoiding it during the reclining.

With reference to a flow chart shown in FIG. 12, here will be described the basic controls of the rolling action for discriminating the shoulder position and the waist position. This rolling action is performed mainly before the aforementioned "treatment course" or "diagnostic inquiry course" is selected so that the massage actions by the treatment course are executed.

At Step 1, the air is released from all the air cells 33L and 33R, the air cells 45L and 45R and the air cells 51L and 51R.

At Step 2, it is discriminated whether or not the upper limit switch S1 is ON. If the upper limit switch S1 is not ON, the routine advances to Step 3, at which the massage drive unit 11 is moved upward. As a result, the massage drive unit 11 is moved to the upper limit position A1 so that it is held standby for starting the rolling action.

When the massage drive unit 11 reaches the upper limit position A1 so that the upper limit switch S1 is turned ON, the routine advances from Step 2 to Step 4, at which it is discriminated whether or not the internal pressure of the air cell 45 reaches the initial pressure Po. If the internal pressure has not reached Po, the air supply source 101 such as a pump is activated at Step 5 to feed the air cell 45 with the air through the solenoid valve 102 or the like. If it is decided at Step 4 that the internal pressure of the air cell 45 reaches the initial pressure Po, the solenoid valve 102 is closed at Step 6, and the routine advances to Step 7.

Figure 25:
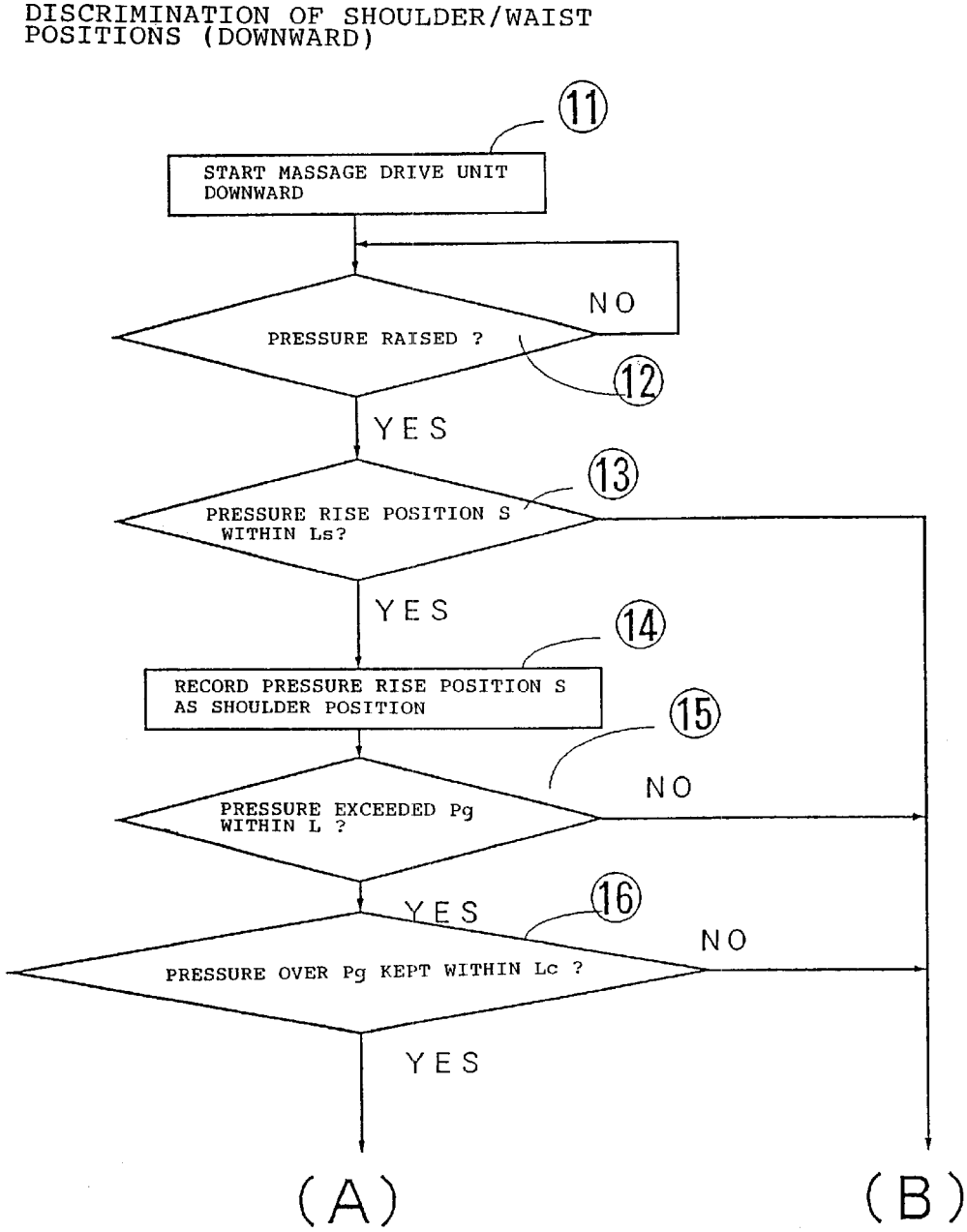
FIG. 25 is a flow chart showing rolling actions of a downward movement.
Figure 26:
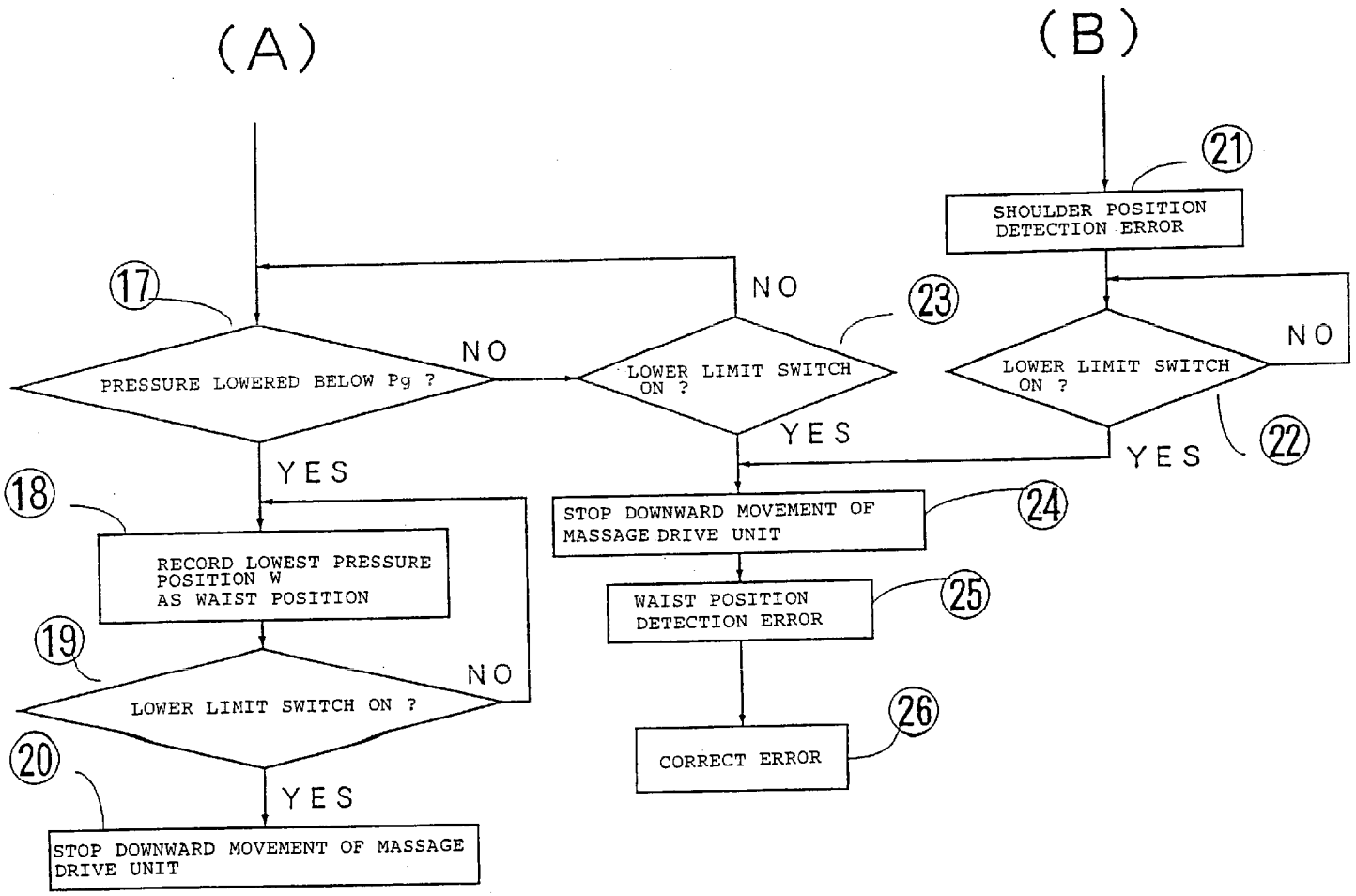
FIG. 26 is a flow chart showing the rolling actions of the downward movement.
Figure 27:
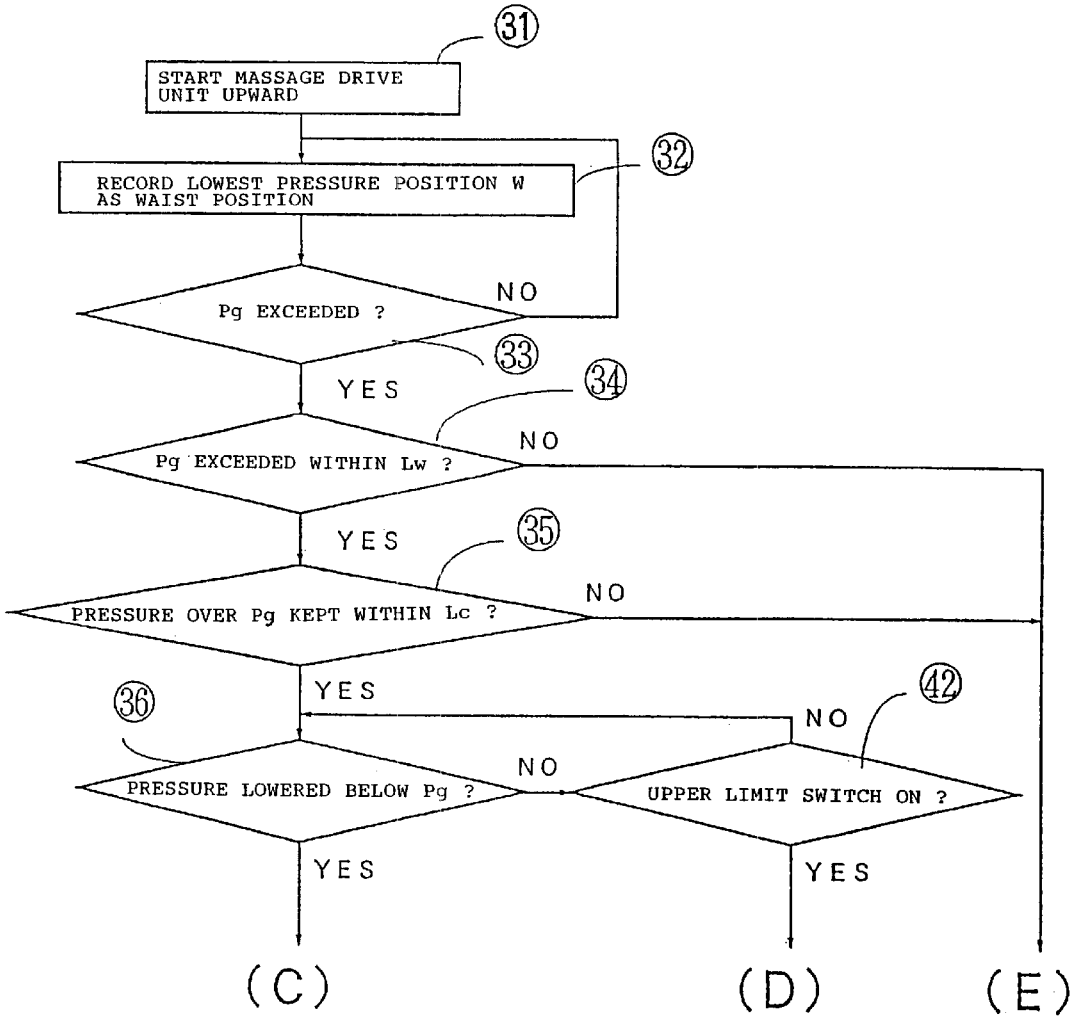
FIG. 27 is a flow chart showing rolling actions of an upward movement.
Figure 28:
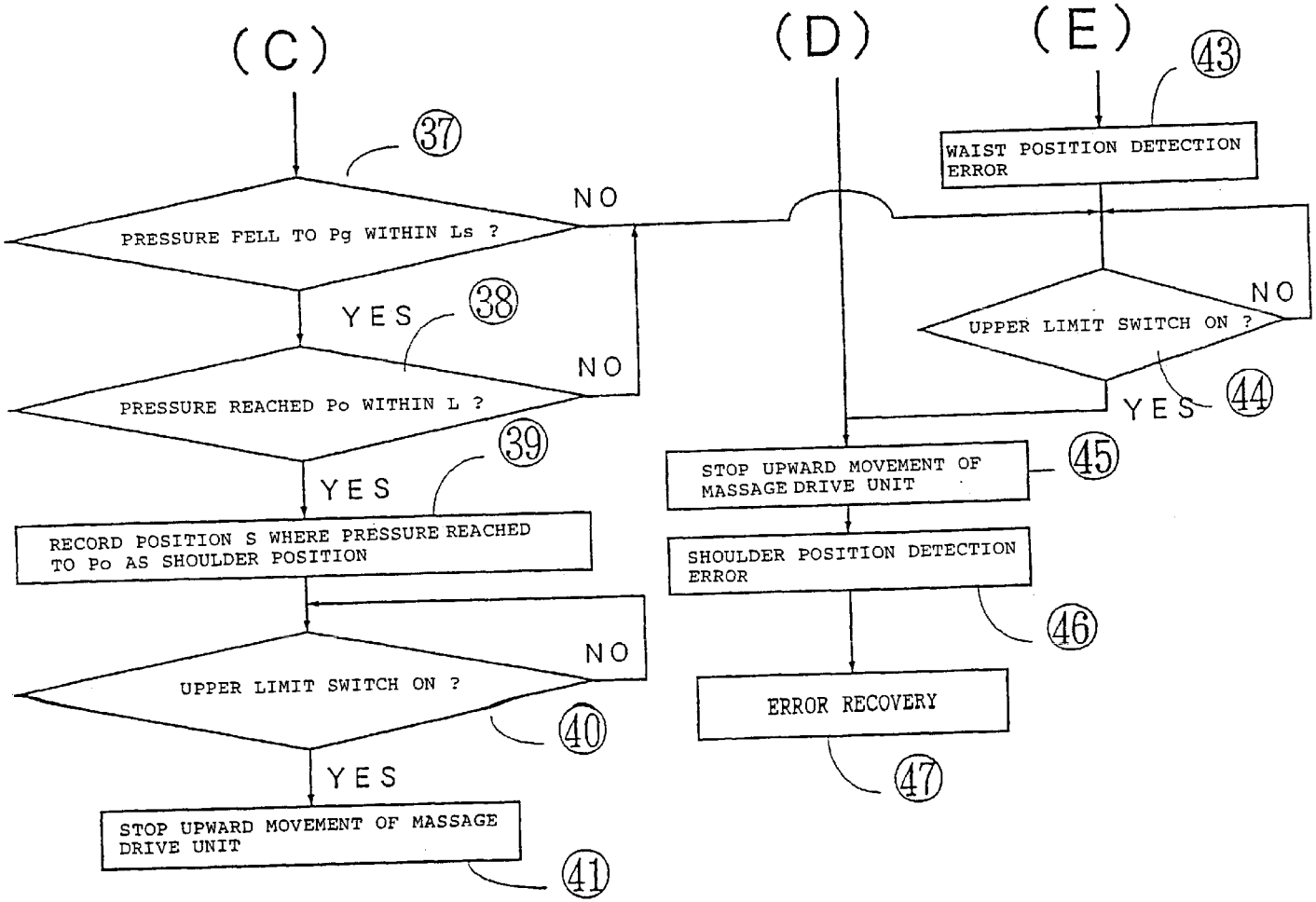
FIG. 28 is a flow chart showing the rolling actions of the upward movement.

At Step 7, as shown in FIGS. 25 and 26, the shoulder position and the waist position are discriminated by performing the downward rolling action from the upper limit position A1 to the lower limit position A2. At Step 8, as shown in FIGS. 27 and 28, the shoulder position and the waist position are discriminated by performing the upward moving action from the lower limit position A2 to the upper limit position A1.

At Step 9, it is discriminated whether or not the rolling actions are made by 2 rounds. If the rolling actions are not made by two rounds, the routine returns to Step 4. As a result, the rolling actions are performed by two rounds, that is, the discriminations of the shoulder position and the waist position are made four times.

If it is discriminated at Step 9 that the rolling actions are made by two rounds, the routine advance to Step 10, at which the shoulder position and the waist position are decided from the combination of the four shoulder positions and waist positions, as discriminated by the rolling actions of Step 7 and Step 8. From the average value of the shoulder position and the average value of the waist position, as effectively discriminated with no detection error, for example, the shoulder position and the waist position are decided.

With reference to the graph shown in FIG. 13 and the flow charts shown in FIGS. 25 and 26, here will be described the rolling actions from the upper limit position A1 to the lower limit position A2.

At Step 11, the downward movement of the massage drive unit 11 is started. At Step 12, it is discriminated whether or not the internal pressure of the air cell 45 has risen. If the internal pressure of the air cell 45 has not risen, the routine returns to Step 12. If the internal pressure of the air cell 45 has risen, the routine advances to Step 13. Therefore, the discriminations of Step 12 are repeated till the internal pressure of the air cell 45 rises from the initial pressure Po.

At Step 13, it is discriminated whether or not the position S where the internal pressure of the air cell 45 has risen is within the range Ls. If the position S is not within the range Ls, the routine advances to Step 21, at which the detected shoulder position is judged as erroneous. If the position S is within the range Ls, the routine advances to Step 14, at which the pressure rise position S is recorded as the shoulder position, and the routine advances to Step 15. Only when the pressure rise position S is within the range Ls, therefore, the position S is discriminated as the shoulder position, but otherwise the detected shoulder position is judged as erroneous.

At Step 15, by the time the massage drive unit 11 proceeds from the position S with the range L, it is continuously discriminated whether or not the internal pressure of the air cell 45 has exceeded the threshold value Pg. If the internal pressure of the air cell 45 does not exceed the threshold value Pg, the routine advances to Step 21, at which the detected shoulder position is judged as erroneous. If the internal pressure of the air cell 45 exceeds the threshold value Pg, the routine advances to Step 16.

If the rising rate of the internal pressure of the air cell 45 with respect to the moving distance of the massage drive unit 11 from the position S is higher than a predetermined value, the detected shoulder position is not judged as erroneous. If, however, the rising rate of the internal pressure of the air cell 45 is not higher than the predetermined value because the using person badly seats himself or herself or floats his or her back during the rolling action or because the pressure sensor 45 operates erroneously, the detected shoulder position is judged as erroneous.

At Step 16, it is discriminated whether or not the internal pressure of the air cell 45 keeps a level over the threshold value Pg while the massage drive unit 11 is moving downward within the range Lc. If the pressure over the threshold value Pg is not kept within the range Lc, the routine advances to Step 21, at which the detected shoulder position is judged as erroneous. If the pressure over the threshold value Pg is kept within the range Lc, the routine advances to Step 17.

If the pressure over the threshold value Pg is kept within the range Lc, therefore, the detected shoulder position is not judged as erroneous. If the internal pressure of the air cell 45 on the back near the shoulder position of the human body of the using person is below the threshold value Pg because the using person badly seats himself or herself or floats his or her back during the rolling action, the shoulder position of the human body cannot be accurately discriminated so that the shoulder position is erroneously detected.

Where it is discriminated at Step 13 that the rise position S of the internal pressure of the air cell 45 is not within the range Ls, where it is discriminated at Step 15 the internal pressure of the air cell 45 has not exceeded the threshold value Pg within the range L from the pressure rise position S, or where it is decided at Step 16 that the pressure over the threshold value Pg is not kept within the range Lc, the routine advances from Step 13, Step 15 or Step 16 to Step 21, at which the detected shoulder position is judged as erroneous, and the routine advances further to Step 22.

At Step 22, moreover, it is discriminated whether or not the lower limit switch S2 is ON. If this lower limit switch S2 is not ON, the routine returns to Step 22. If the lower limit switch S2 is ON, the routine advances to Step 24, at which the downward movement of the massage drive unit 11 is stopped. At Step 25, the detected waist position is judged as erroneous, and at Step 26, the detection error is displayed in the not-shown display unit.

Therefore, where the internal pressure of the air cell 45 has not risen from the initial pressure Po while the massage drive unit 11 is moving downward within the range Ls, where the internal pressure of the air cell 45 has not exceeded the threshold value Pg while the massage drive unit 11 is moving downward from the position S to the range L, or where the internal pressure of the air cell 45 has not continuously kept a pressure over the threshold value Pg while the massage drive unit 11 is moving downward within the range Lc, the detected shoulder position is judged as erroneous, and the detected waist position is judged erroneous.

At Step 17, it is discriminated whether or not the internal pressure of the air cell 45 has dropped to a level below the threshold value Pg while the massage drive unit 11 is moving downward from the lower end of the range Lc toward the lower limit position A2. If the internal pressure of the air cell 45 has not dropped below the threshold value Pg, the routine advances to Step 23, at which it is discriminated whether or not the lower limit switch S2 is ON. If the lower limit switch S2 is not ON, the routine returns to Step 17.

Therefore, the discriminations are repeated on the routes of Step 17 and Step 23 till the internal pressure of the air cell 45 has dropped below the threshold value Pg while the massage drive unit 11 is moving from the lower end of the range Lc to the lower limit position A2.

If it is discriminated at Step 17 that the internal pressure of the air cell 45 has dropped below the threshold value Pg, the routine advances to Step 18, at which the position W where the internal pressure of the air cell 45 takes the minimum is recorded as the waist position. The routine advances to Step 19, at which it is discriminated whether or not the lower limit switch S2 is ON. If this lower limit switch S2 is not ON, the routine returns to Step 18.

Therefore, where the shoulder location is discriminated and where the internal pressure of the air cell 45 has become lower than the threshold value Pg after the massage drive unit 11 exceeded the range Lc and before the same reaches the lower limit position A2, the position W where the internal pressure takes the minimum is discriminated as the waist position.

If it is discriminated at Step 19 that the lower limit switch S2 is ON, the routine advances to Step 20, at which the downward movement of the massage drive unit 11 is stopped. Where the shoulder position and the waist position are effectively discriminated, therefore, the massage drive unit 11 moves downward and stops at the lower limit position A2.

If it is discriminated at Step 23 that the lower limit switch S2 is ON, on the other hand, the downward movement of the massage drive unit 11 is stopped at Step 24, and the detected shoulder position is judged as erroneous at Step 25. At Step 26, the error correction is made by displaying the detection error in the not-shown display unit.

Even where the shoulder location is discriminated, therefore, the detected waist position is judged as erroneous if the internal pressure of the air cell 45 has not become lower than the threshold value Pg after the massage drive unit 11 exceeded the range Lc and before the same reaches the lower limit position A2.

With reference to the graph shown in FIG. 14 and the flow charts shown in FIGS. 27 and 28, here will be described the rolling actions from the lower limit position A2 to the upper limit position A1.

At Step 31, the upward movement of the massage drive unit 11 is started. At Step 32, the position W where the internal pressure of the air cell 45 is the lowest is recorded as the waist position. At Step 33, it is discriminated whether or not the internal pressure of the air cell 45 has exceeded the threshold value Pg. If the threshold value Pg is not exceeded, the routine returns to Step 31. If the threshold value Pg is exceeded, the routine advances to Step 34.

Therefore, the position W where the internal pressure of the air cell 45 takes the minimum after the massage drive unit 11 started the upward movement and before the internal pressure of the air cell 45 exceeds the threshold value Pg is discriminated as the waist position.

At Step 34, it is discriminated the internal pressure of the air cell 45 has exceeded the threshold value Pg while the massage drive unit 11 is moving upward within the range Lw from the lower limit position A2. If the threshold value Pg is not exceeded while the massage drive unit 11 is moving upward within the range Lw, the routine advances to Step 43, at which the detected waist position is judged as erroneous. If the threshold value Pg is exceeded while the massage drive unit 11 is moving upward within the range Lw, the routine advances to Step 35.

If the threshold value Pg is exceeded while the massage drive unit 11 is moving upward from the lower limit position A2 within the range Lw, therefore, the detected waist position is not judged as erroneous. Where the threshold value Pg is not exceeded while the massage drive unit 11 is moving upward from the lower limit position A2 within the range Lw because the using person badly seats himself or herself or floats his or her back during the rolling action or because the pressure sensor 45 operates erroneously, the detected waist position is judged as erroneous.

At Step 35, it is discriminated whether or not the internal pressure of the air cell 45 has kept a pressure higher than the threshold value Pg while the massage drive unit 11 is moving upward within the range Lc. If the internal pressure of the air cell 45 has not kept a pressure higher than the threshold value Pg, the routine advances to Step 43, at which the detected waist position is judged as erroneous. If the internal pressure of the air cell 45 has kept the pressure over the threshold value Pg, the routine advances to Step 36.

If the internal pressure of the air cell 45 has kept a pressure over the threshold value Pg while the massage drive unit 11 is moving upward within the range Lc, therefore, the detected waist position is not judged as erroneous. If the internal pressure of the air cell 45 on the back near the waist position of the human body of the using person is below the threshold value Pg because the using person badly seats himself or herself or floats his or her back during the rolling action, the waist position of the human body cannot be accurately discriminated so that the waist position is erroneously detected.

On the other hand, where it is discriminated at Step 34 that the threshold value Pg is not exceeded while the massage drive unit 11 is moving upward within the range Lw, or where it is discriminated at Step 35 that the internal pressure of the air cell 45 has not kept a pressure higher than the threshold value Pg while the massage drive unit 11 is moving upward within the range Lc, the routine advances from Step 34 or Step 35 to Step 43, at which the detected waist position is judged as erroneous, and the routine advances to Step 44. At Step 44, it is discriminated whether or not the upper limit switch S1 is ON. If the upper limit switch S1 is not ON, the routine returns to Step 44. If the lower limit switch S2 is ON, the routine advances to Step 45, at which the upward movement of the massage drive unit 11 is stopped. At Step 46, the detected waist position is judged as erroneous. At Step 47, the error correction is made by displaying the detection error in the not-shown display unit.

Therefore, where the threshold value Pg is not exceeded while the massage drive unit 11 is moving upward within the range Lw, or where the internal pressure of the air cell 45 has not kept a pressure over the threshold value Pg while the massage drive unit 11 is moving upward within the range Lc, the detected waist position and the detected shoulder position are judged as erroneous.

At Step 36, it is discriminated whether or not the internal pressure of the air cell 45 has dropped below the threshold value Pg. If the internal pressure of the air cell 45 has not dropped below the threshold value Pg, the routine advances to Step 42, at which it is discriminated whether or not the upper limit switch S1 is ON. If this upper limit switch S1 is not ON, the routine returns to Step 36.

Therefore, the discriminations are repeated on the routes of Step 36 and Step 42 till the internal pressure of the air cell 45 drops to the threshold value Pg after the upward movement of the massage drive unit 11 passed the range Lc.

At Step 37, it is discriminated whether or not the internal pressure of the air cell 45 has dropped below the threshold value Pg while the massage drive unit 11 is moving upward within the range Ls. If the position where the internal pressure has dropped below the threshold value Pg is not within the range Ls, the routine advances to Step 44. If the position where the internal pressure has dropped below the threshold value Pg is within the range Ls, the routine advances to Step 38.

At Step 38, it is discriminated whether or not the internal pressure of the air cell 45 has reached the initial pressure Po while the massage drive unit 11 is moving upward within the range L from the position where the internal pressure of the air cell 45 has dropped below the threshold value Pg. If the initial pressure Po is not reached within the range L, the routine advances to Step 44. If the initial pressure Po is reached within the range L, the routine advances to Step 39.

At Step 39, the position S where the internal pressure of the air cell 45 has reached the initial pressure Po is recorded as the shoulder position. At Step 40, it is decided whether or not the upper limit switch S1 is ON. If not ON, the routine returns to Step 40. If the switch S1 is ON, the upward movement of the massage drive unit 11 is stopped.

Only where the internal pressure of the air cell 45 drops to the threshold value Pg within the range Ls and, while the massage drive unit 11 is moving upward from the drop position within the range L, the internal pressure of the air cell 45 further drops to the initial pressure Po, the position S where the initial pressure Po is taken is discriminated as the shoulder position.

Where it is discriminated at Step 42 that the upper limit switch S1 is ON, on the other hand, the routine advances from Step 42 to Step 45, at which the upward movement of the massage drive unit 11 is stopped. After this, the detected shoulder position is judged as erroneous at Step 46, and the error correction is made at Step 47.

Where it is discriminated at Step 37 that the position where the internal pressure of the air cell 45 has dropped below the threshold value Pg is not within the range Ls, or where it is discriminated at Step 38 that the internal pressure of the air cell 45 has not reached the initial pressure Po while the massage drive unit 11 is moving upward within the range L from the position where the internal pressure of the air cell 45 has dropped to the threshold value Pg, on the other hand, the routine advances from Step 37 or Step 38 to Step 44, at which it is discriminated whether or not the upper limit switch S1 is ON. If not ON, the routine returns to Step 44, but if ON, the routine advances to Step 45, at which the upward movement of the massage drive unit 11 is stopped. After this, the detected shoulder position is judged as erroneous at Step 46, and the error correction is made at Step 47 by displaying the detection error in the not-shown display unit.

Therefore, where the internal pressure of the air cell 45 has dropped below the threshold value Pg while the massage drive unit 11 is moving upward within the range other than the range Ls after it passed the range Lc, where the internal pressure of the air cell 45 has not dropped below the threshold value Pg while the massage drive unit 11 is moving upward within the range Ls, or where the internal pressure of the air cell 45 has not returned to the initial pressure Po while the massage drive unit 11 is moving upward within the range L, the detected shoulder position is judged as erroneous.

After the shoulder position and the waist position were decided, as described above, the massage drive unit 11 is moved on the basis of the shoulder position and the waist position, as discriminated, to massage the desired position of the using person. Where the shoulder is to be massaged as the pint of the massage actions, for example, the massage drive unit 11 is moved for the massage actions to the discriminated shoulder position.

Where the "Treatment Course" is selected or where the "Diagnostic inquiry Course" is selected to set the treatment course according to the diagnostic inquiry, on the other hand, the massage actions are made to stimulate the effective spot positions individually for the treatments, as shown in the flow charts of FIGS. 29 to 35.

Figure 29:
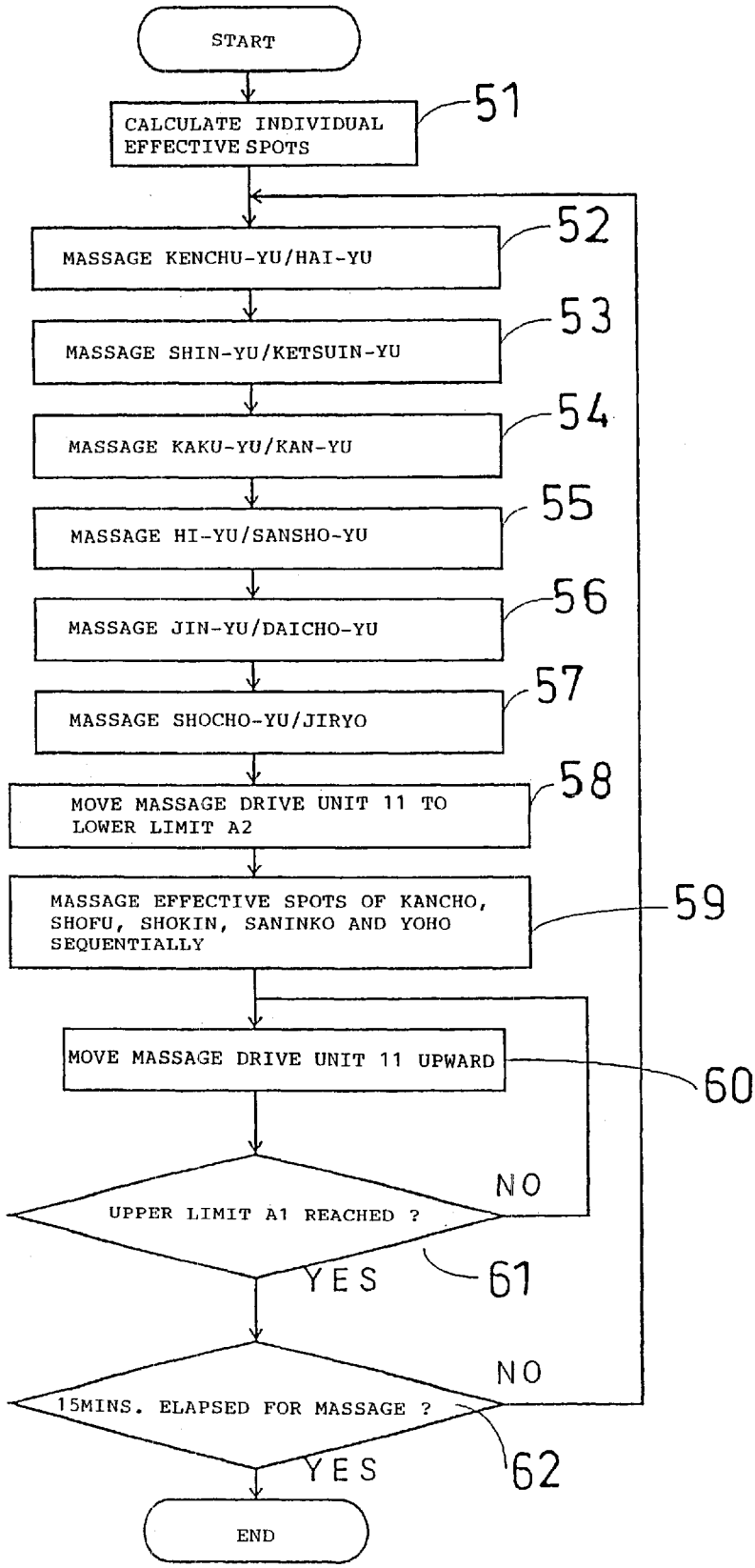
FIG. 29 is a flow chart showing massage actions of a treatment course.

At Step 51 in FIG. 29, the individual spot positions of: the "Kenchu-Yu/Hai-Yu"; the "Shin-Yu/Ketsuin-Yu"; the "Kaku-Yu/Kan-Yu"; the "Hi-Yu/Sansho-Yu"; the "Jin-Yu/Daicho-Yu"; and the "Shocho-Yu/Jiryo" are calculated in advance from the discriminated shoulder position by the effective spot calculating means 118 of the control unit 111.

Figure 30:
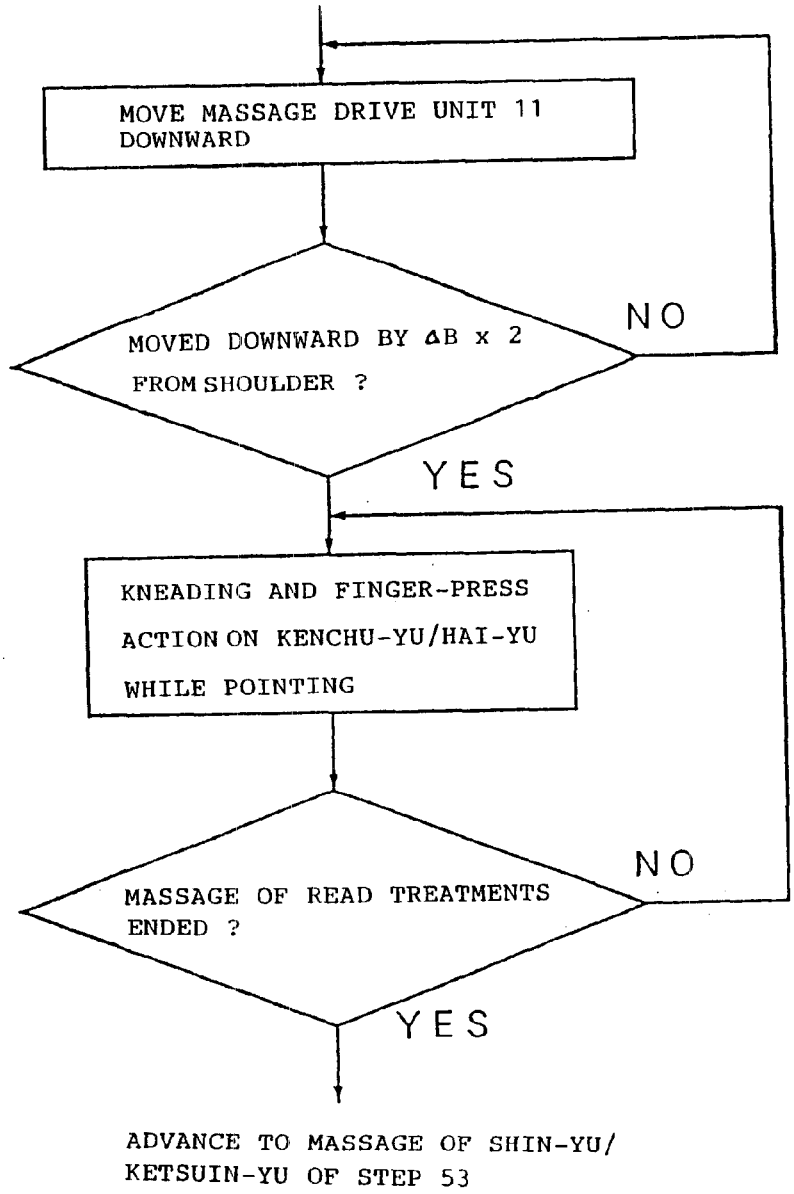
FIG. 30 is a flow chart showing massage actions of the effective spots of Kenchu-Yu/Hai-Yu.
Figure 31:
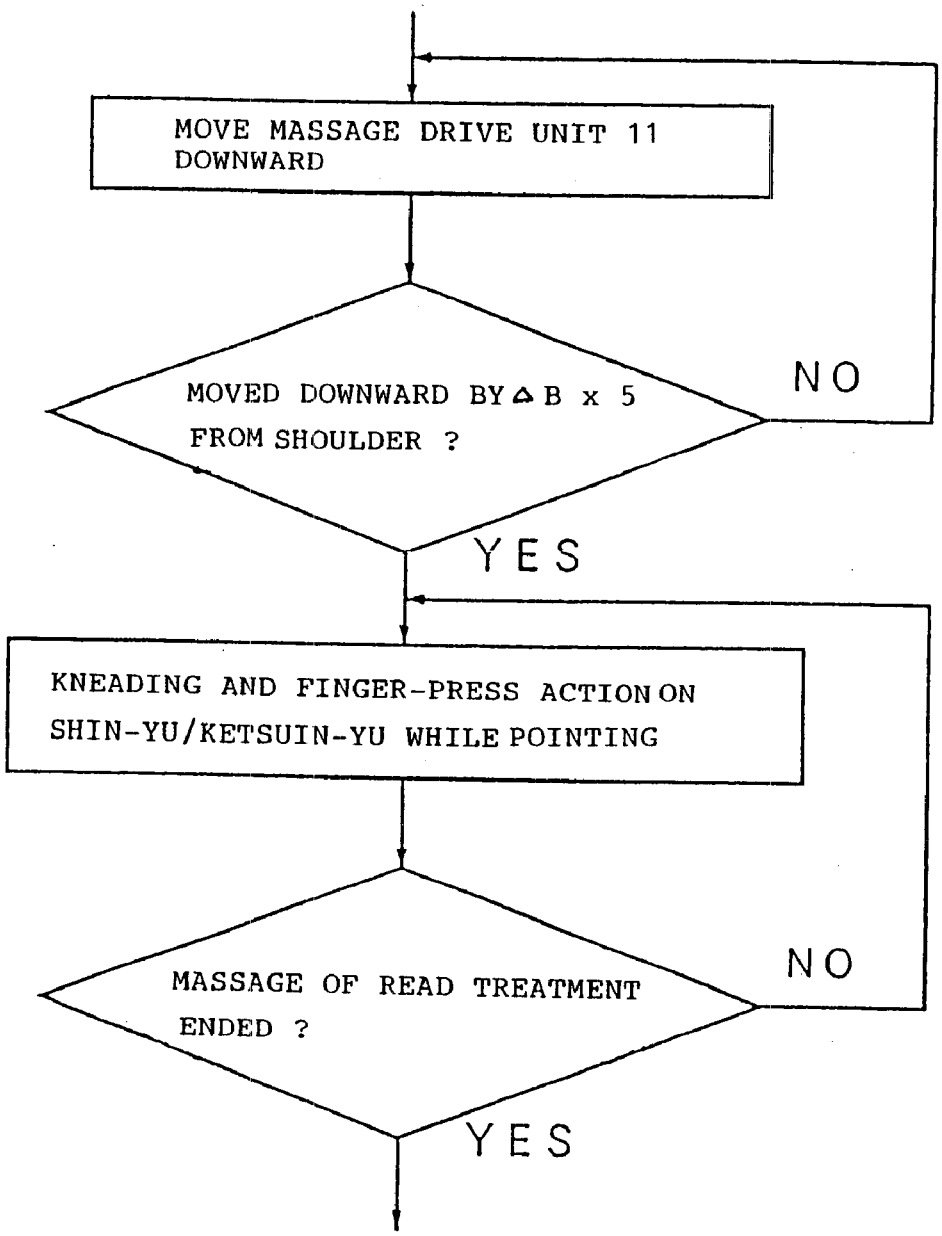
FIG. 31 is a flow chart showing massage actions of the effective spots of Shin-Yu/Ketsuin-Yu.
Figure 32:
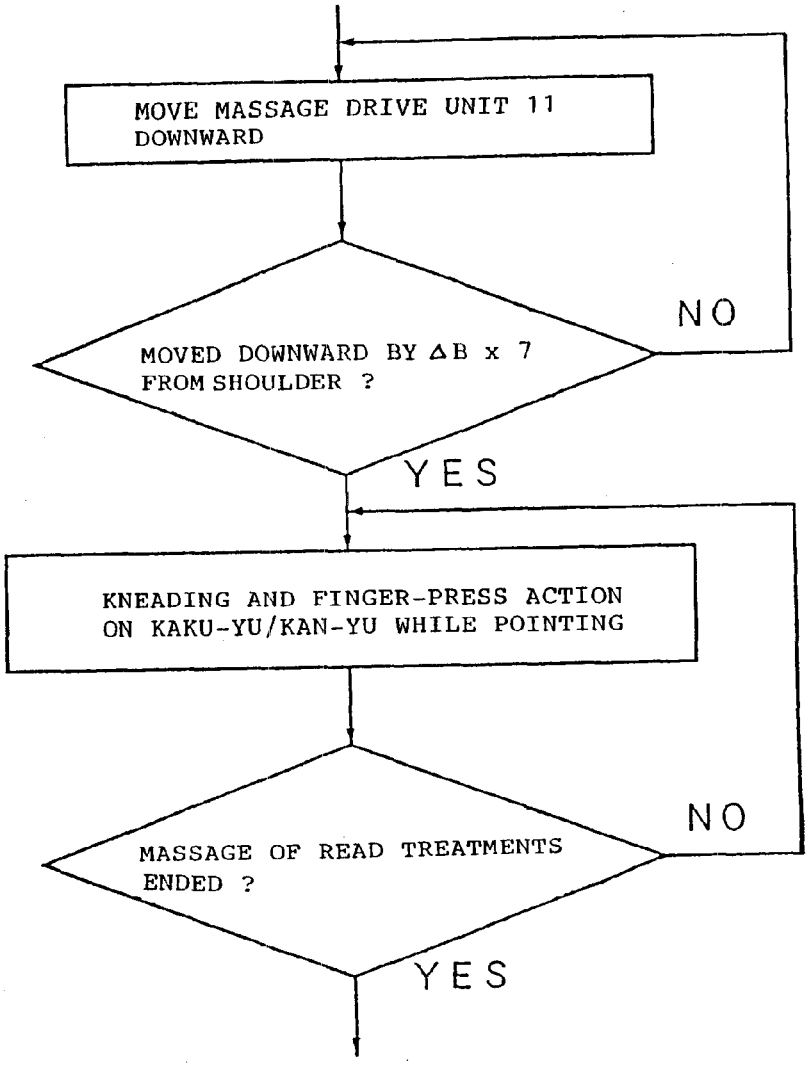
FIG. 32 is a flow chart showing massage actions of the effective spots of Kaku-Yu/Kan-Yu.
Figure 33:
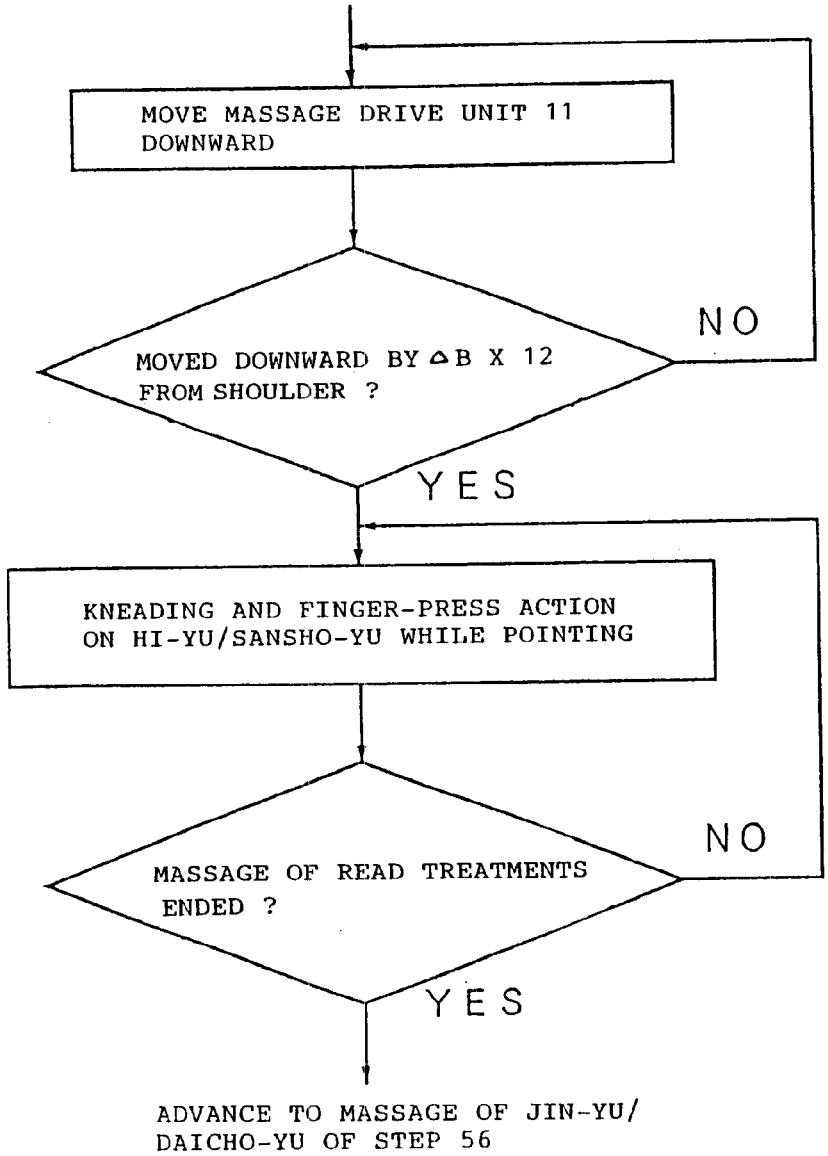
FIG. 33 is a flow chart showing massage actions of the effective spots of Hi-Yu/Sansho-Yu.
Figure 34:
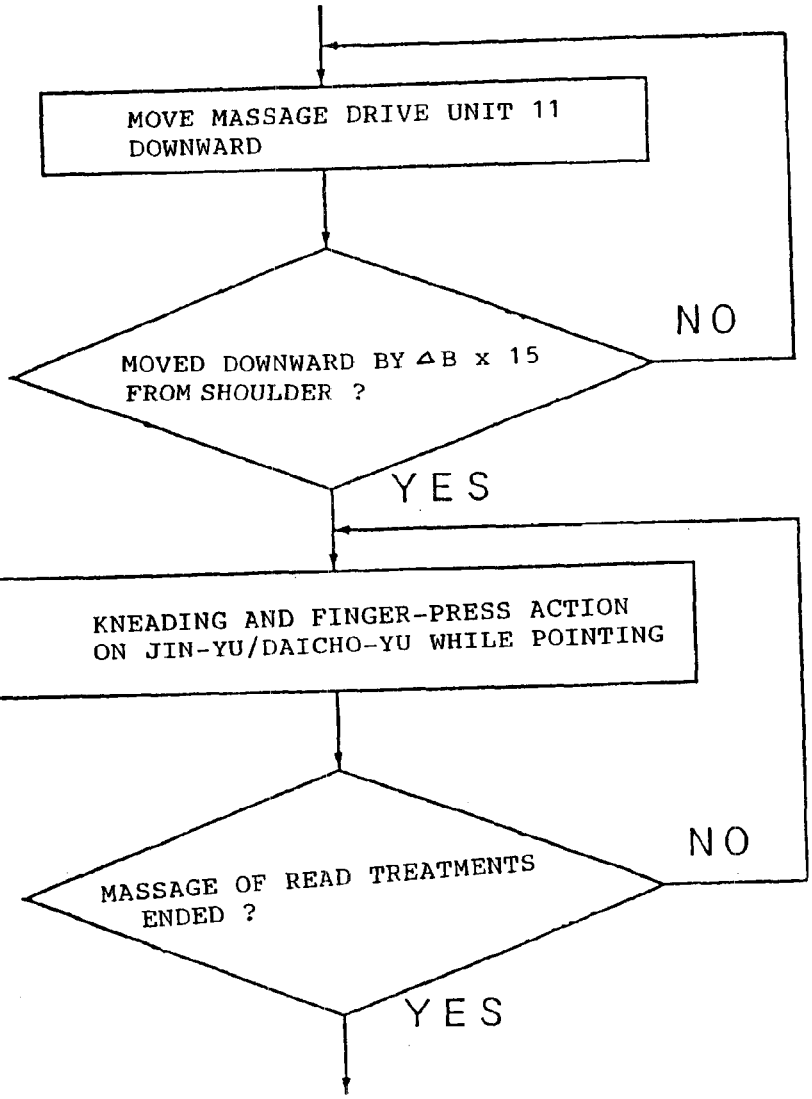
FIG. 34 is a flow chart showing massage actions of the effective spots of Jin-Yu/Daicho-Yu.
Figure 35:
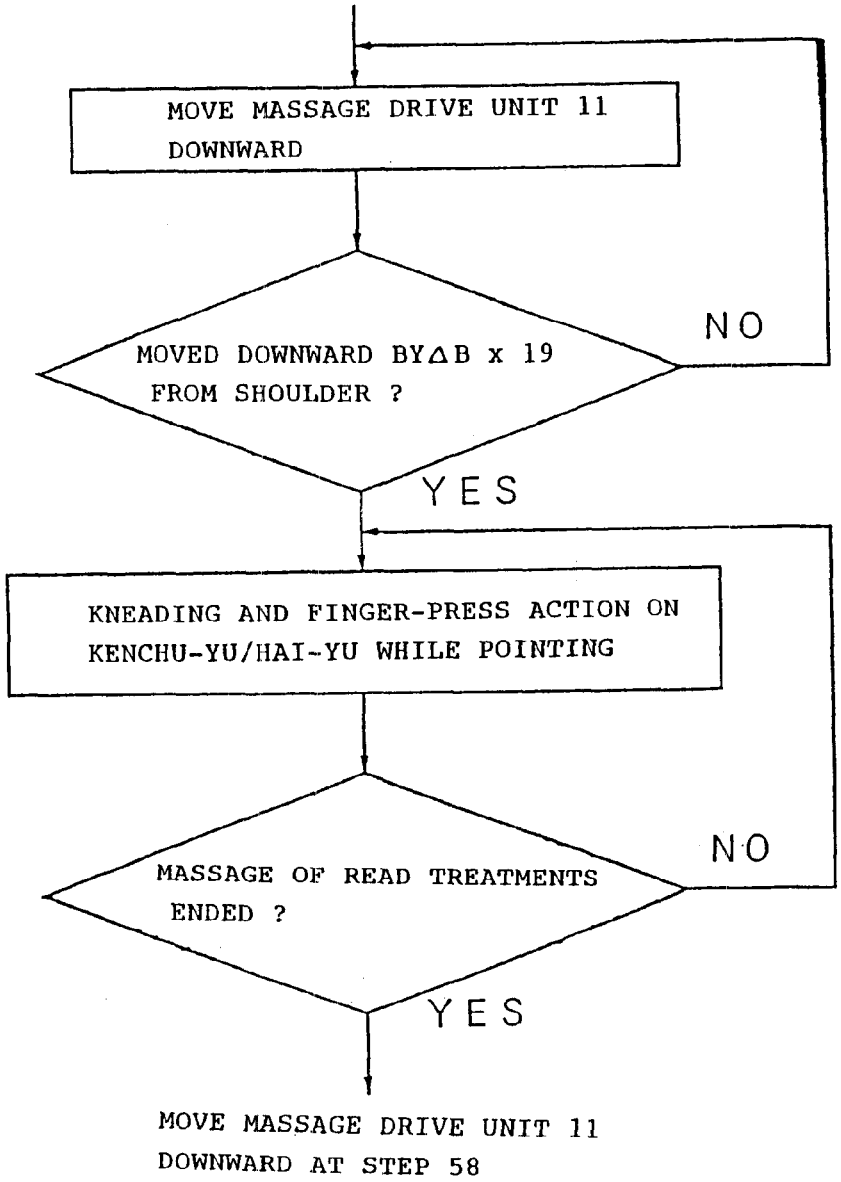
FIG. 35 is a flow chart showing massage actions of the effective spots of Shocho-Yu/Jiryo.

At Step 52, as shown in FIG. 30, the spot position of the "Kenchu-Yu/Hai-Yu" is massaged with the massage members 23 and 25 of the massage drive unit 11. At Step 53, as shown in FIG. 31, the spot position of the "Shin-Yu/Ketsuin-Yu" is massaged with the massage members 23 and 25 of the massage drive unit 11. At Step 54, as shown in FIG. 32, the spot position of the "Kaku-Yu/Kan-Yu" is massaged with the massage members 23 and 25 of the massage drive unit 11. At Step 55, as shown in FIG. 33, the spot position of the "Hi-Yu/Sansho-Yu" is massaged with the massage members 23 and 25 of the massage drive unit 11. At Step 56, as shown in FIG. 34, the spot position of the "Jin-Yu/Daicho-Yu" is massaged with the massage members 23 and 25 of the massage drive unit 11. At Step 57, as shown in FIG. 35, the spot position of the "Shocho-Yu/Jiryo" is massaged with the massage members 23 and 25 of the massage drive unit 11.

The massage actions on the "Kenchu-Yu/Hai-Yu" at Step 51 are made to perform the finger-press and kneading massage actions according to the treatment contents, as enumerated in Tables 1 to 6, of the selected or set treatment course, as shown in FIG. 30, by moving the massage drive unit 11 downward to the spot positions of the "Kenchu-Yu/Hai-Yu" calculated by the effective spot calculating means 118 and then by performing the pointing actions of a vertical width of about 3 cm with the massage members 23 and 25 of the massage drive unit 11.

On the other hand, the massage actions on the "Shin-Yu/Ketsuin-Yu"; the "Kaku-Yu/Kan-Yu"; the "Hi-Yu/Sansho-Yu"; the "Jin-Yu/Daicho-Yu"; and the "Shocho-Yu/Jiryo", as indicated at Step 53 to Step 58, are made to perform the finger-press and kneading massage actions according to the treatment contents, as enumerated in Tables 1 to 6, of the selected or set treatment course, as likewise shown in FIGS. 31 to 35, by moving the massage drive unit 11 downward to the individual spot positions calculated by the effective spot calculating means 118 and then by performing the pointing actions of a vertical width of about 3 cm with the massage members 23 and 25 of the massage drive unit 11.

If the mental refreshing course is selected or set as the treatment course by the diagnostic inquiry, for example, as enumerated in Table 1, the "Kenchu-Yu/Hai-Yu" and the "Shin-Yu/Ketsuin-Yu" are strongly massaged and the "Kaku-Yu/Kan-Yu"; the "Hi-Yu/Sansho-Yu"; the "Jin-Yu/Daicho-Yu"; and the "Shocho-Yu/Jiryo" are weakly massaged by the massage members 23 and 25 of the massage drive unit 11.

At Step 58, the massage drive unit 11 is moved to and stopped at the lower limit position A2. After this, at Step 59, the effective spots on the legs of the human body, i.e., the "Kancho", the "Shofu", the "Shokin" and the "Saninko/Yoho" are sequentially massaged according to the treatment contents, as read out from Tables 1 to 6, by the massage members or the individual air cells 80, 81, 85, 86 and 87. In this case, according to the treatment contents, as enumerated in Tables 1 to 6, of the treatment course selected or set, the "Kancho" is massaged with finger-press massage action by activating the air cells 80L and 80R. Then, the "Shofu" is massaged with finger-press massage action by activating the air cells 81L and 81R. Moreover, the "Shokin" is massaged with finger-press massage action by activating the air cells 85L and 85R. Finally, the "Saninko/Yoho" are massaged with pinching and finger-press massage actions by activating the air cells 86L, 86R and 87L, 87R.

If the metal refreshing course is selected or set by the diagnostic inquiry as the treatment course, therefore, the "Shokin" and the "Saninko/Yoho" are strongly massaged whereas the "Kancho" and the "Shofu" are weakly massaged, as enumerated in Table 1.

After this, the routine advances to Step 60, at which the massage drive unit 11 is moved upward. At Step 61, it is discriminated whether or not the massage drive unit 11 has reached the upper limit position A1. If the upper limit position A1 is not reached, the routine returns to Step 60, at which the upward movement of the massage drive unit 11 is continued. If the upper limit position A1 is reached, the upward movement of the massage drive unit 11 is stopped, and the routine advances to Step 62.

At Step 62, it is discriminated whether or not the massage actions have been continued for 15 minutes. If the massage actions have been continued for within 15 minutes, the routine returns to Step 52, at which the massage actions are repeated. If the massage actions have been continued for 15 minutes or longer, the routine advances to Step 63, at which the massage actions according to the treatment course are ended. Therefore, the massage actions of the treatment course are ended after repeating the massage actions for about 15 minutes.

Here, the present invention should not be limited to the embodiment thus far described. Specifically, the diagnostic inquiry result screen 53 may display not only the physical condition information but also a general advice for instructing the life guidance according to the physical condition information and the manner how to use the massage chair according to the physical condition information.

On the other hand, the control unit 111 may be made not to set the treatment courses but to display the treatment course suited for the physical condition of the using person on the basis of the diagnosis results in the diagnostic inquiry result screen 53 so that the course recommended by the diagnostic inquiry result may be executed by the manual input of the using person.

Where the control unit 111 sets the treatment course, on the other hand, the course contents may be partially changed and set according to the physical condition.

On the other hand, the predetermined treatment courses, as displayed in the treatment course select screen 42, is not selected and set, but the control unit 111 or the setting means may synthesize and set the treatment course in accordance with the physical condition discriminated.

On the other hand, the diagnostic inquiry means and the input means may be such that the diagnostic inquiry and the answer is made through dialogues in voice in place of the screen display and the switch operations. In this modification, the remaining various operations can also be effected by the dialogues.

On the other hand, there may be provided storage means for storing the information (or answers) obtained by the diagnostic inquiry, so that the stored information can be utilized for next massages.

On the other hand, the massaging apparatus need not be of the chair type but can adopt various types such as a mat type.

On the other hand, the foregoing embodiment is provided with both the upper massage member and the lower massage member. However, the invention can be practiced by either of the upper and lower massage members.

In the above-described embodiment, on the other hand, the positions of the specific portions such as the shoulder position of the body of the using person with respect to the massaging apparatus are discriminated from the relations between the moving position of the massage drive unit 11 and the internal pressure of the air cell 45, as detected by the pressure sensor 105. Alternatively, the using person may be advised to input his or her height so that the positions of the specific portions such as the shoulder position may be discriminated.

According to the invention, as has been described hereinbefore, the Keiketsu (or the effective spot positions) in the Eastern Medical Science can be effectively stimulated to obtain sufficient treatment effects according to the treatment purpose.

INDUSTRIAL APPLICABILITY

The present invention is useful as the massaging apparatus and especially as the chair type massaging apparatus.

What is claimed is:

1. A massaging apparatus for massaging a body of a using person with a massage member, comprising:

memory means recorded with treatment contents; and control means for causing the massage member to massage in accordance with the treatment contents recorded in said memory means;

position discriminating means for discriminating the position of a specific portion of the body of the using person; and effective spot calculating means for calculating an effective spot position of the using person from the specific portion position, as discriminated by said position discriminating means, of the body of the using person, whereby said massage member is caused to perform the massage actions by moving the massage member sequentially to a plurality of effective spot positions calculated by said effective spot calculating means; and a massage drive unit including the massage member and an air cell made extensible for protruding the massage member toward the using person and contractible for retracting the massage member from the using person and including a pressure sensor for detecting the internal pressure of said air cell, said massage drive unit being made movable along the body of the using person, whereby said massage member is moved along the body of the using person while being protruded toward the using person by the extension of said air cell, so that the position of the specific portion of the body of the using person with respect to said massaging apparatus may be discriminated from the relations between the moving position of the massage member at the time and the internal pressure of the air cell, as detected by said pressure sensor, said treatment contents recorded in said memory means indicating effective spot positions of the body of the using person to be massaged according to a treatment course and massage actions to be applied to said effective spot positions, and said effective spot positions including Keiketsu and being selected in accordance with a treatment course.

2. A massaging apparatus as set forth in claim 1, further comprising:

treatment course select means for selecting the treatment course, whereby the treatment contents corresponding to the treatment course selected by said treatment course select means are read out from said memory means so that the effective spot positions including the Keiketsu of the body of the using person may be massaged with the massage member by said control means in accordance with the read treatment contents.

3. A massaging apparatus according to claim 1, wherein the moving position of the massage drive unit when a changing rate of the internal pressure of said air cell to the moving distance of said massage drive unit fluctuates is discriminated as the position of the specific portion of the body of the using person with respect to said massaging apparatus.

4. A massaging apparatus according to claim 1, wherein the moving position of the massage drive unit when the internal pressure of said air cell starts or ends the fluctuation is discriminated as the position of the specific portion of the body of the using person with respect to said massaging apparatus.

5. A massaging apparatus as set forth in claim 1, wherein said position discriminating means discriminate the shoulder position of the body, and wherein said effective spot calculating means calculates the positions of the individual thoracic vertebrae and the individual lumbar vertebrae from the shoulder position and calculates the effective spots including the Keiketsu from the calculated positions of the thoracic vertebrae and the lumbar vertebrae.

6. A massaging apparatus as set forth in claim 1, wherein when the effective spots of the body of the using person are to be massaged with said massage member, said massage member is caused to perform a pointing action to repeat the massage actions while moving with a width of several centimeters.

7. A massaging apparatus as set forth in claim 1, further comprising:

diagnostic inquiry means for performing a diagnostic inquiry to the using person;

input means for inputting the answer of the using person to said diagnostic inquiry means; and treatment course decision means for deciding the treatment course on the basis of said answer.

8. The massaging apparatus as set forth in claim 1, wherein the treatment contents recorded in said memory means are the effective spot positions to be massaged according to the treatment course and the massage actions to be made on the effective spot positions and are programmable.

9. A massaging apparatus according to claim 1, wherein said massage member is made movable along the body of the using person for massaging the effective spots including the Keiketsu along the backbone of the body of the using person.

10. A massaging apparatus according to claim 1, wherein said massage member includes an air cell to be caused to extend/contract by feeding/discharging compressed air, for massaging the effective spots including the Keiketsu on the legs of the body of the using person.

11. The massaging apparatus according to claim 1, wherein the Keiketsu includes at least one effective spot position selected from Kenchu-Yu, Hai-Yu, and Shin-Yu.

12. A massaging apparatus for massaging a body of a using person with a massage member, comprising:

a memory device recorded with treatment contents;

a control device configured to cause the massage member to massage in accordance with the treatment contents recorded in said memory means;

position discriminating device configured to discriminate the position of a specific portion of the body of the using person;

effective spot calculating device configured to calculate an effective spot position of the using person from the specific portion position, as discriminated by said position discriminating device, of the body of the using person, whereby said massage member is caused to perform massage actions by moving the massage member sequentially to a plurality of effective spot positions including the Keiketsu calculated by said effective spot calculating device; and a massage drive unit including the massage member and an air cell made extensible for protruding the massage member toward the using person and contractible for retracting the massage member from the using person and including a pressure sensor for detecting the internal pressure of said air cell, said massage drive unit being made movable along the body of the using person, whereby said massage member is moved along the body of the using person while being protruded toward the using person by the extension of said air cell, so that the position of the specific portion of the body of the using person with respect to said massaging apparatus may be discriminated from the relations between the moving position of the massage member at the time and the internal pressure of the air cell, as detected by said pressure sensor, said treatment contents recorded in said memory means indicating effective spot positions of the body of the using person to be massaged according to a treatment course and massage actions to be applied to said effective spot positions, and said effective spot positions including Keiketsu and being selected in accordance with a treatment course.

* * * * *